US011214062B2

(12) United States Patent
Uematsu et al.

(10) Patent No.: US 11,214,062 B2
(45) Date of Patent: Jan. 4, 2022

(54) LIQUID DISCHARGING APPARATUS

(71) Applicant: Seiko Epson Corporation, Tokyo (JP)

(72) Inventors: Hidekazu Uematsu, Fujimi (JP); Ryo Hirabayashi, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/005,531

(22) Filed: Aug. 28, 2020

(65) Prior Publication Data

US 2021/0060944 A1 Mar. 4, 2021

(30) Foreign Application Priority Data

Aug. 30, 2019 (JP) ..... JP2019-157932

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/1433
See application file for complete search history.

(56) References Cited

U.S. PATENT DOCUMENTS

| | | | | |
|---|---|---|---|---|
| 2003/0146954 | A1 | 8/2003 | Tamura | |
| 2018/0086075 | A1 | 3/2018 | Matsumoto et al. | |
| 2020/0180330 | A1* | 6/2020 | Aizawa | B41J 15/042 |
| 2020/0313414 | A1* | 10/2020 | Kawa | H02G 3/14 |

FOREIGN PATENT DOCUMENTS

| | | |
|---|---|---|
| JP | 2003-226006 A | 8/2003 |
| JP | 2018-051953 A | 4/2018 |

* cited by examiner

*Primary Examiner* — Lamson D Nguyen
(74) *Attorney, Agent, or Firm* — Harness, Dickey & Pierce, P.L.C.

(57) ABSTRACT

A liquid discharging apparatus includes: a drive unit that includes a discharging head that discharges liquid; a first board that includes a control circuit that controls the discharging head; a first cable for electrical coupling between the control circuit and the drive unit; a second cable for electrical coupling between the control circuit and the drive unit; and housing inside which the drive unit, the first board, the first cable, and the second cable are housed. The second cable includes a shield layer containing a conductive material. The position of the first cable is between the housing and the second cable.

8 Claims, 13 Drawing Sheets

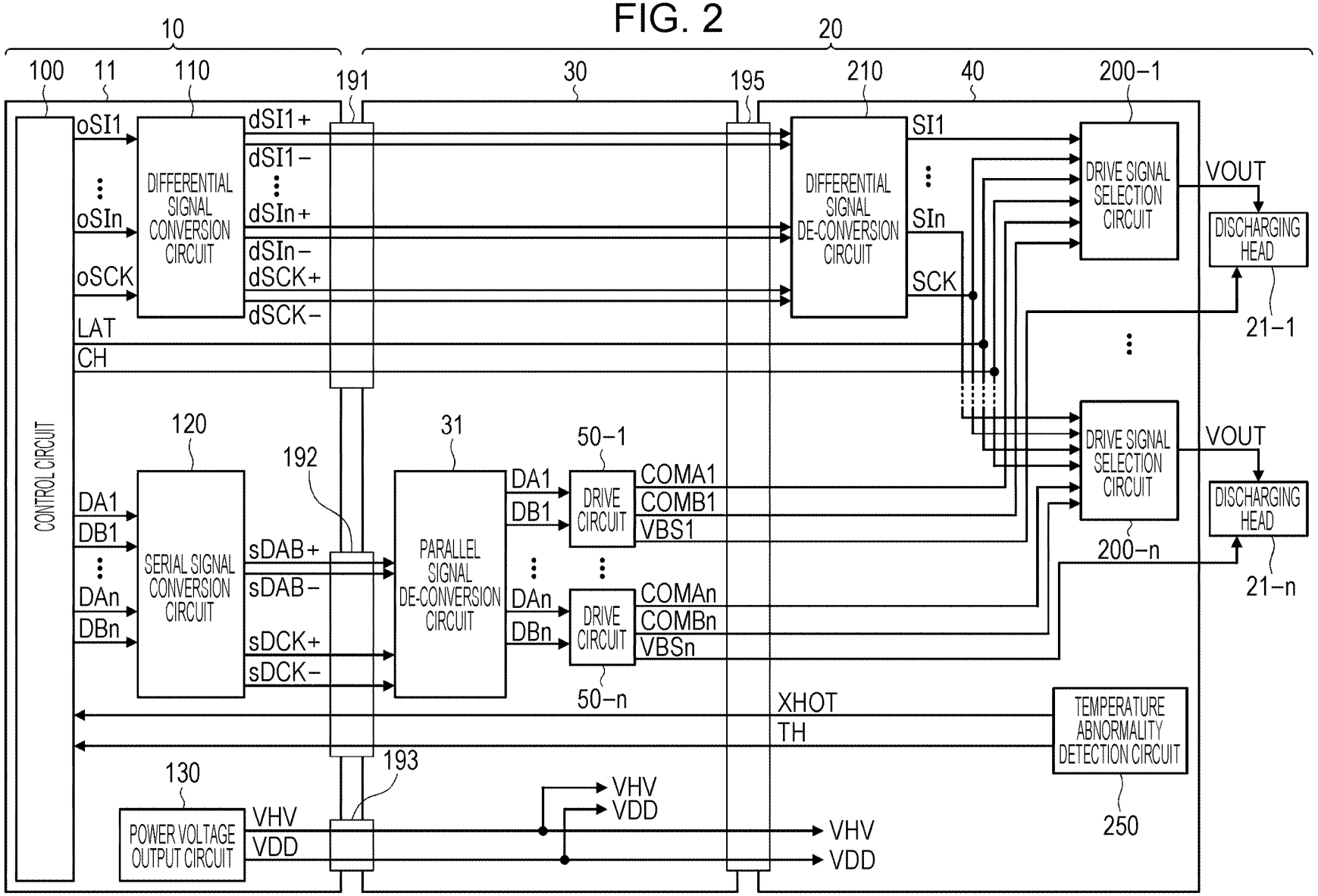
FIG. 2
10
11
100
110
120
130
20
30
31
40
50−1
50−n
21−1
21−n
191
192
193
195
200−1
200−n
210
250
DISCHARGING HEAD
VOUT
DRIVE SIGNAL SELECTION CIRCUIT
DIFFERENTIAL SIGNAL DE-CONVERSION CIRCUIT
TEMPERATURE ABNORMALITY DETECTION CIRCUIT
SI1
SIn
SCK
COMA1
COMB1
VBS1
COMAn
COMBn
VBSn
DRIVE CIRCUIT
DA1
DB1
DAn
DBn
PARALLEL SIGNAL DE-CONVERSION CIRCUIT
XHOT
TH
VHV
VDD
dSI1+
dSI1−
dSIn+
dSIn−
dSCK+
dSCK−
DIFFERENTIAL SIGNAL CONVERSION CIRCUIT
sDAB+
sDAB−
sDCK+
sDCK−
SERIAL SIGNAL CONVERSION CIRCUIT
POWER VOLTAGE OUTPUT CIRCUIT
oSI1
oSIn
oSCK
LAT
CH
CONTROL CIRCUIT

| [SIH, SIL] | | [1, 1] LARGE DOT | [1, 0] MEDIUM-SIZED DOT | [0, 1] SMALL DOT | [0, 0] NON-PRINTING |
|---|---|---|---|---|---|
| S1 | T1 | H | H | H | L |
| | T2 | H | L | L | L |
| S2 | T1 | L | L | L | H |
| | T2 | L | H | L | L |

LIQUID DISCHARGING APPARATUS

The present application is based on, and claims priority from JP Application Serial Number 2019-157932, filed Aug. 30, 2019, the disclosure of which is hereby incorporated by reference herein in its entirety.

BACKGROUND

1. Technical Field

Embodiments of the present disclosure relate to a liquid discharging apparatus.

2. Related Art

A liquid discharging apparatus such as an ink jet printer prints an image or a text on a medium by discharging ink. In some liquid discharging apparatuses of related art, a piezoelectric element such as, for example, a piezo-actuation element is used. A piezoelectric element is provided individually for each of a plurality of nozzles in a print head. These individual piezoelectric elements are driven in accordance with drive signals. As a result, ink corresponding to the drive amount is discharged from the nozzles, thereby forming dots on a medium.

A liquid discharging apparatus includes various components besides a print head that discharges ink. Among them are a drive circuit board on which a drive circuit for generating drive signals for driving piezoelectric elements is mounted, a control circuit board on which a control circuit for controlling the supply of the drive signals to the piezoelectric elements is mounted, to name but a few.

Various components included in a liquid discharging apparatus are electrically coupled via signal propagation cables such as, for example, flexible flat cables.

For example, the following technique is disclosed in JP-A-2003-226006. A liquid discharging apparatus includes a plurality of flexible flat cables via which drive signals for driving piezoelectric elements propagate. In the liquid discharging apparatus, wires via which drive signals propagate and wires via which reference potential of drive signals propagates face each other and are at positions overlapping with each other. By this means, the mutual interference of the signals that propagate via the flexible flat cables is reduced.

Regarding a flexible cable via which various kinds of signals for controlling the operation of a liquid discharging apparatus propagate, JP-A-2018-051953 disclose a technique of reducing the mutual interference of signals that propagate via flexible flat cables, achieved by causing the various kinds of signals for controlling the operation of the liquid discharging apparatus to propagate via the flexible flat cable including a shield layer.

However, in the liquid discharging apparatus disclosed in JP-A-2003-226006, it is necessary to provide ground wires facing the wires via which drive signals propagate and, therefore, the number of wires in the flexible flat cable via which ground signals propagate increases. Therefore, the area occupied by the flexible flat cable in the liquid discharging apparatus might increase, resulting in an increase in the size of the liquid discharging apparatus.

Moreover, in the liquid discharging apparatus disclosed in JP-A-2003-226006, if the number of signals that propagate via the flexible flat cable increases, wiring density in the flexible flat cable increases. Therefore, misalignment of the ground wires facing the wires via which drive signals propagate might occur. To reduce the risk of misalignment, it is necessary to provide an extra component for misalignment reduction. This might make the structure of the liquid discharging apparatus more complex, resulting in an increase in the size of the liquid discharging apparatus.

In the liquid discharging apparatus disclosed in JP-A-2018-051953, it is possible to reduce the mutual interference of signals that propagate via flexible flat cables because the flexible flat cable includes the shield layer individually, even if misalignment of the ground wires facing the wires via which drive signals propagate occurs. However, in the liquid discharging apparatus disclosed in JP-A-2018-051953, since the flexible flat cable includes the shield layer individually, as compared with a flexible flat cable that does not include a shield layer, the thickness and width of the flexible flat cable is greater. Therefore, the area occupied by the flexible flat cable might increase, resulting in an increase in the size of the liquid discharging apparatus.

As explained above, in a liquid discharging apparatus of related art in which signals propagate via a plurality of cables, there is a room for improvement in terms of preventing an increase in the size of the liquid discharging apparatus.

SUMMARY

A liquid discharging apparatus according to a certain aspect includes: a drive unit that includes a discharging head that discharges liquid; a first board that includes a control circuit that controls the discharging head; a first cable for electrical coupling between the control circuit and the drive unit; a second cable for electrical coupling between the control circuit and the drive unit; and housing inside which the drive unit, the first board, the first cable, and the second cable are housed; wherein the second cable includes a shield layer containing a conductive material, and a position of the first cable is between the housing and the second cable.

In the liquid discharging apparatus according to the certain aspect, the drive unit may include a second board electrically coupled to the first cable and the second cable, and the first board and the second board may be fastened to the housing.

In the liquid discharging apparatus according to the certain aspect, the first cable may be without a shield layer containing a conductive material.

The liquid discharging apparatus according to the certain aspect may further include a third cable that has a terminal pitch larger than a terminal pitch of the first cable; wherein a position of the second cable may be between the first cable and the third cable.

The liquid discharging apparatus according to the certain aspect may further include a fourth cable via which a power voltage of the drive unit propagates; wherein a position of the second cable may be between the first cable and the fourth cable.

In the liquid discharging apparatus according to the certain aspect, the first cable may be in contact with at least one of the second cable and the housing.

In the liquid discharging apparatus according to the certain aspect, a frequency of a first signal that propagates via the first cable may be lower than a frequency of a second signal that propagates via the second cable.

In the liquid discharging apparatus according to the certain aspect, a third signal that indicates a status of the discharging head may propagate via the second cable.

BRIEF DESCRIPTION OF THE DRAWINGS

FIG. 2 is a diagram that illustrates an electric configuration of the liquid discharging apparatus.

DESCRIPTION OF EXEMPLARY EMBODIMENTS

With reference to the accompanying drawings, a certain non-limiting advantageous embodiment of the present disclosure will now be explained. The drawings will be referred to in order to facilitate an explanation. The specific embodiment described below shall never be construed to unduly limit the scope of the present disclosure recited in the appended claims. Not all of components described below necessarily constitute indispensable parts of the present disclosure.

1. Structure of Liquid Discharging Apparatus

Figure 1:
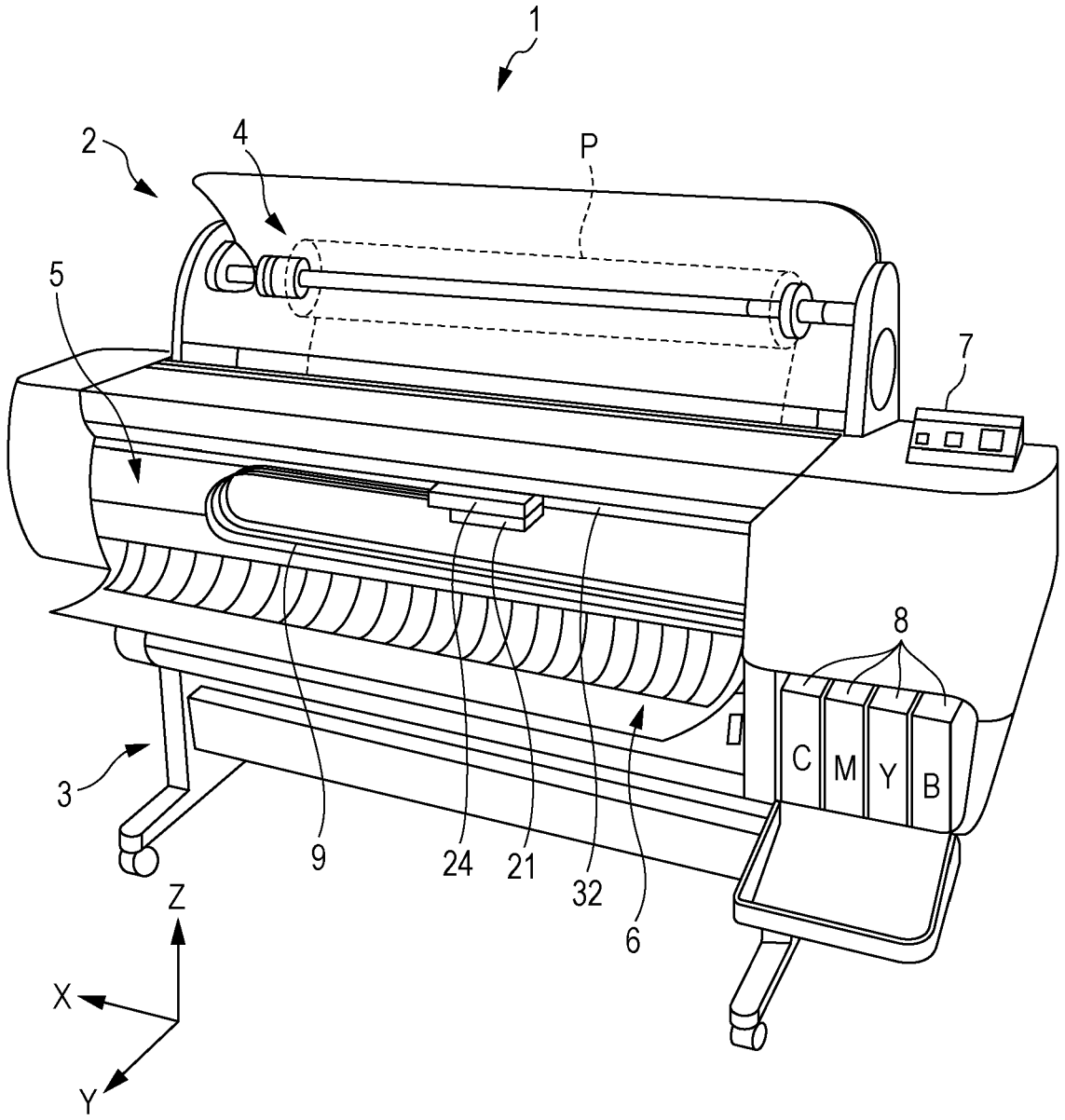
FIG. 1 is a diagram that illustrates an example of the appearance of a liquid discharging apparatus.

FIG. 1 is a diagram that illustrates an example of the appearance of a liquid discharging apparatus 1. The liquid discharging apparatus 1 according to the present embodiment is a serial-scan-type ink jet printer, and is a so-called large format printer (LFP). The liquid discharging apparatus 1 includes a body 2 and a supporting stand 3, which supports the body 2. In the explanation below, the direction in which a carriage 24 of the liquid discharging apparatus 1 moves will be described as the X direction, the direction in which a medium P of the liquid discharging apparatus 1 is transported will be described as the Y direction, and the vertical direction of the liquid discharging apparatus 1 will be described as the Z direction. Although the description below will be given based on an assumption that the X, Y, and Z directions are directions of three X, Y, and Z axes orthogonal to one another, the positional relationships of components of the liquid discharging apparatus 1 are not necessarily limited to those based on such orthogonality.

As illustrated in FIG. 1, the body 2 includes a supply unit 4, a printing unit 5, an ejection unit 6, an operation unit 7, and an ink container portion 8. The supply unit 4 supplies a medium P that is roll paper. The printing unit 5 performs printing by discharging ink as an example of liquid onto the medium P. The ejection unit 6 ejects the medium P after printing by the printing unit 5 to the outside of the body 2. The operation unit 7 is used for operating the liquid discharging apparatus 1 for, for example, executing or stopping printing. The ink container portion 8 is a portion where ink to be discharged is contained. A USB port and a power supply port, etc. may be provided on the back of the body 2 of the liquid discharging apparatus 1, though not illustrated. Namely, the liquid discharging apparatus 1 is driven by a power supply voltage inputted via the power supply port and forms an image corresponding to image data inputted via the USB port from a computer, etc. on the medium P.

The printing unit 5 includes the carriage 24, a carriage guide shaft 32, and ink tubes 9.

A discharging head 21 is mounted on the bottom of the carriage 24 and thus faces the medium P. The discharging head 21 includes many nozzles. Ink is discharged from the nozzles. The carriage 24 reciprocates in the X direction while being supported by the carriage guide shaft 32. In this structure, the medium P is transported in the Y direction. Ink is discharged from the discharging head 21 with reciprocating motion of the carriage 24 in the X direction and with transportation of the medium P in the Y direction. Ink droplets ejected land onto the medium P at targeted positions. In this way, an image is formed on the medium P as instructed.

A plurality of ink cartridges is attached to the ink container portion 8. Each ink cartridge is filled with ink of a corresponding color. In the example illustrated in FIG. 1, four ink cartridges corresponding to four color components of C (cyan), M (magenta), Y (yellow), and B (black) are mounted on the liquid discharging apparatus 1. Five or more ink cartridges may be mounted on the liquid discharging apparatus 1. The colors of ink contained in the ink cartridges may include a color other than C (cyan), M (magenta), Y (yellow), and B (black). Ink contained in each ink cartridge is supplied through the ink tube 9 to the discharging head 21. Then, ink of the corresponding color is discharged from many nozzles of the discharging head 21.

2. Electric Configuration of Liquid Discharging Apparatus

Next, with reference to FIG. 2, an electric configuration of the liquid discharging apparatus 1 will now be explained. FIG. 2 is a diagram that illustrates an electric configuration of the liquid discharging apparatus 1. As illustrated in FIG. 2, the liquid discharging apparatus 1 includes a drive unit 20, which forms an image by discharging ink onto the medium P, and a control unit 10, which controls the operation of the drive unit 20.

The control unit 10 includes a main circuit board 11. A control circuit 100, a differential signal conversion circuit 110, a serial signal conversion circuit 120, and a power voltage output circuit 130 are mounted on the main circuit board 11. The main circuit board 11 is an example of a first board.

The control circuit 100 outputs a control signal for controlling each component of the liquid discharging apparatus 1, based on image data supplied from a host computer.

Specifically, based on a signal supplied from the host computer, the control circuit 100 generates an original clock signal oSCK and original print data signals oSI1 to oSIn as control signals for controlling the discharging of ink from the discharging head 21, and outputs these signals to the differential signal conversion circuit 110.

The differential signal conversion circuit 110 converts the inputted original clock signal oSCK into a pair of differential signals dSCK+ and dSCK−, and outputs them to the drive unit 20. In addition, the differential signal conversion circuit 110 converts each of the inputted original print data signals oSI1 to oSIn into the corresponding one of pairs of differential signals dSI1+ to dSIn+ and dSI1− to dSIn−, and outputs them to the drive unit 20. The differential signals dSCK+ and dSCK− and the differential signals dSI1+ to dSIn+ and dSI1− to dSIn− after conversion by the differential signal conversion circuit 110 may be differential signals conforming to the LVDS (Low Voltage Differential Signaling) transfer scheme or may be any of various high-speed transfer schemes other than LVDS such as LVPECL (Low Voltage Positive Emitter Coupled Logic) or CML (Current Mode Logic).

Based on a signal supplied from the host computer, the control circuit 100 generates a latch signal LAT and a change signal CH as control signals for controlling the timing of discharging ink from the discharging head 21, and outputs them to the drive unit 20.

Based on a signal supplied from the host computer, the control circuit 100 generates source drive signals DA1 to DAn and DB1 to DBn, on which drive signals COMA and COMB for driving the discharging head 21 are based, and outputs them to the serial signal conversion circuit 120.

The serial signal conversion circuit 120 converts the source drive signals DA1 to DAn and DB1 to DBn, which are inputted as signals in a parallel format, into signals in a serial format. The serial signal conversion circuit 120 further converts the converted signals in the serial format into a pair of differential signals sDAB+ and sDAB−, and outputs them to the drive unit 20.

In addition, the serial signal conversion circuit 120 generates a pair of differential signals sDCK+ and sDCK−, which contain clock cueing the timing of de-conversion when the pair of differential signals sDAB+ and sDAB− containing the source drive signals DA1 to DAn and DB1 to DBn serially is converted back into the signals in the parallel format, and outputs them to the drive unit 20.

Based on power inputted from an external source such as a commercial power supply, the power voltage output circuit 130 generates voltages VHV and VDD, which are used in the liquid discharging apparatus 1, and outputs them to the drive unit 20. The voltage VHV is, for example, a direct-current voltage of 42 V and is used as an amplification voltage at drive circuits 50-1 to **50-*n*, etc. The voltage VDD is, for example, a direct-current voltage of 3.3 V and is used as a power voltage for causing each component of the liquid discharging apparatus 1 to operate. The power voltage output circuit 130 may generate a voltage signal that has a voltage value different from both of the values of the voltages VHV and VDD, and may supply it to each component of the liquid discharging apparatus 1. The voltage VHV, VDD outputted from the power voltage output circuit 130 may be used as a power voltage and/or a drive voltage of each circuit included in the control unit 10**.

The drive unit 20 includes a drive circuit board 30, a discharge circuit board 40, and the discharging head 21. A parallel signal de-conversion circuit 31 and a plurality n of drive circuits 50-1 to **50-*n* are mounted on the drive circuit board 30. The drive circuit board 30** is an example of a second board.

The pair of differential signals sDAB+ and sDAB− and the pair of differential signals sDCK+ and sDCK− outputted from the serial signal conversion circuit 120 of the main circuit board 11 are inputted into the parallel signal de-conversion circuit 31. The parallel signal de-conversion circuit 31 de-converts the source drive signals DA1 to DAn and DB1 to DBn in the parallel format by applying de-conversion to the pair of differential signals sDAB+ and sDAB− at the timing cued by the pair of differential signals sDCK+ and sDCK−, and outputs them to the drive circuits 50-1 to **50-*n*** respectively.

The source drive signals DA1 and DB1 are inputted into the drive circuit 50-1. The drive circuit 50-1 converts the inputted source drive signal DA1 into an analog signal. After the conversion, the drive circuit 50-1 performs class-D amplification on the converted analog signal, thereby generating and outputting a drive signal COMA1 to the discharge circuit board 40. The drive circuit 50-1 converts the inputted source drive signal DB1 into an analog signal. After the conversion, the drive circuit 50-1 performs class-D amplification on the converted analog signal, thereby generating and outputting a drive signal COMB1 to the discharge circuit board 40. In addition, the drive circuit 50-1 generates a reference voltage signal VBS1, which serves as a reference when the discharging head 21 described later discharges ink, and outputs it to the discharge circuit board 40.

Similarly, the source drive signals DAn and DBn are inputted into the drive circuit **50-*n*. The drive circuit 50-*n* converts the inputted source drive signal DAn into an analog signal. After the conversion, the drive circuit 50-*n* performs class-D amplification on the converted analog signal, thereby generating and outputting a drive signal COMAn to the discharge circuit board 40. The drive circuit 50-*n* converts the inputted source drive signal DBn into an analog signal. After the conversion, the drive circuit 50-*n* performs class-D amplification on the converted analog signal, thereby generating and outputting a drive signal COMBn to the discharge circuit board 40. In addition, the drive circuit 50-*n* generates a reference voltage signal VBSn, which serves as a reference when the discharging head 21 described later discharges ink, and outputs it to the discharge circuit board 40**.

The differential signals dSCK+ and dSCK−, the differential signals dSI1+ to dSIn+ and dSI1− to dSIn−, the latch signal LAT, the change signal CH, and the voltages VHV and VDD are inputted into the drive circuit board 30 from the main circuit board 11. Receiving the input of the differential signals dSCK+ and dSCK−, the differential signals dSI1+ to dSIn+ and dSI1− to dSIn−, the latch signal LAT, the change signal CH, and the voltages VHV and VDD, the drive circuit board 30 relays and outputs them to the discharge circuit board 40. That is, the drive circuit board 30 behaves also as a relay board that relays the signals outputted from the main circuit board 11.

Among the differential signals dSCK+ and dSCK−, the differential signals dSI1+ to dSIn+ and dSI1− to dSIn−, the latch signal LAT, the change signal CH, and the voltages VHV and VDD, which are inputted into the drive circuit board 30, the latch signal LAT, the change signal CH, and the voltages VHV and VDD may be inputted into each of the drive circuits 50-1 to **50-*n* described above. The drive circuits 50-1 to 50-*n* may be driven by the voltage VDD used as power voltage and may generate the drive signals COMA1 to COMAn and COMB1 to COMBn respectively by amplifying the source drive signals DA1 to DAn and DB1 to DBn to a voltage that is based on the voltage VHV at the timing cued by the latch signal LAT and the change signal CH. In this case, the drive circuits 50-1 to 50-*n* may generate the reference voltage signals VBS1** to VBSn respectively by boosting the voltage VDD.

A differential signal de-conversion circuit 210, drive signal selection circuits 200-1 to **200-*n*, and a temperature abnormality detection circuit 250 are mounted on the discharge circuit board 40**.

Each pair of differential signals dSI1+ to dSIn+ and dSI1− to dSIn− and the pair of differential signals dSCK+ and dSCK− are inputted into the differential signal de-conversion circuit 210. The differential signal de-conversion circuit 210 generates print data signals SI1 to SIn by performing de-conversion from the differential signals dSI1+ to dSIn+ and dSI1− to dSIn− into single-end signals, and outputs them to the drive signal selection circuits 200-1 to **200-*n* respectively. In addition, the differential signal de-conversion circuit 210 generates a clock signal SCK by performing de-conversion from the differential signals dSCK+ and dSCK− into a single-end signal, and outputs it to each of the drive signal selection circuits 200-1 to 200-*n***.

The print data signal SI1, the clock signal SCK, the latch signal LAT, the change signal CH, and the drive signals COMA1 and COMB1 are inputted into the drive signal selection circuit 200-1. The drive signal selection circuit 200-1 generates a drive signal VOUT1 by selecting or not selecting the drive signal COMA1, COMB1 at the timing cued by the latch signal LAT and the change signal CH, based on the print data signal SI1, and outputs it to a discharging head 21-1.

Similarly, the print data signal SIn, the clock signal SCK, the latch signal LAT, the change signal CH, and the drive signals COMAn and COMBn are inputted into the drive signal selection circuit **200-*n*. The drive signal selection circuit 200-*n* generates a drive signal VOUTn by selecting or not selecting the drive signal COMAn, COMBn at the timing cued by the latch signal LAT and the change signal CH, based on the print data signal Sin, and outputs it to a discharging head 21-*n***.

The temperature abnormality detection circuit 250 detects the temperature of the discharge circuit board 40 and the temperature of the drive signal selection circuits 200-1 to **200-*n* mounted on the discharge circuit board 40. Then, the temperature abnormality detection circuit 250 generates a temperature abnormality detection signal XHOT, which indicates whether the temperature of the discharge circuit board 40 and/or the temperature of the drive signal selection circuits 200-1 to 200-*n* mounted on the discharge circuit board 40 are/is abnormal or not, and outputs it to the control circuit 100 mounted on the main circuit board 11. In addition, the temperature abnormality detection circuit 250 generates a temperature information signal TH, which indicates the detected temperature, and outputs it to the control circuit 100**.

The drive signal VOUT1 outputted from the drive signal selection circuit 200-1 and the reference voltage signal VBS1 are inputted into the discharging head 21-1. The discharging head 21-1 discharges ink an amount of which corresponds to a level difference between the drive signal VOUT1 and the reference voltage signal VBS1 from its nozzles. Similarly, the drive signal VOUTn outputted from the drive signal selection circuit **200-*n* and the reference voltage signal VBSn are inputted into the discharging head 21-*n*. The discharging head 21-*n*** discharges ink an amount of which corresponds to a level difference between the drive signal VOUTn and the reference voltage signal VBSn from its nozzles.

In the liquid discharging apparatus 1 having the configuration described above, the main circuit board 11 included in the control unit 10 is electrically coupled to the drive circuit board 30 included in the drive unit 20 via cables 191, 192, and 193. In other words, various kinds of signals propagate from the main circuit board 11 to the drive circuit board 30 and from the drive circuit board 30 to the main circuit board 11 via the cables 191, 192, and 193.

Specifically, among the signals that propagate from the main circuit board 11 to the drive circuit board 30, each pair of differential signals dSI1+ to dSIn+ and dSI1− to dSIn−, the pair of differential signals dSCK+ and dSCK−, the latch signal LAT, and the change signal CH propagate via the cable 191. Among the signals that propagate from the main circuit board 11 to the drive circuit board 30, the pair of differential signals sDAB+ and sDAB− and the pair of differential signals sDCK+ and sDCK− propagate via the cable 192. In addition, among the signals that propagate from the drive circuit board 30 to the main circuit board 11, the temperature abnormality detection signal XHOT and the temperature information signal TH propagate via the cable 192. Among the signals that propagate from the main circuit board 11 to the drive circuit board 30, the voltages VHV and VDD propagate via the cable 193.

Similarly, the drive circuit board 30 included in the drive unit 20 is electrically coupled to the discharge circuit board 40 via a cable 195. In other words, various kinds of signals propagate from the drive circuit board 30 to the discharge circuit board 40 and from the discharge circuit board 40 to the drive circuit board 30 via the cable 195.

3. Configuration of Drive Signal Selection Circuit

Next, the configuration of the drive signal selection circuits 200-1 to **200-*n* will now be explained. The drive signal selection circuits 200-1 to 200-*n* have the same configuration as one another. Therefore, in the following explanation, they will be collectively described as a drive signal selection circuit 200. Moreover, the drive signal selection circuit 200 described below receives an input of a print data signal SI as a representative example of the print data signals SI1 to Sin, an input of a drive signal COMA as a representative example of the drive signals COMA1 to COMAn, and an input of a drive signal COMB as a representative example of the drive signals COMB1 to COMBn. Moreover, the drive signal selection circuit 200 described below outputs a drive signal VOUT to a discharging head 21 by selecting or not selecting the drive signal COMA, COMB. Furthermore, the discharging head 21 to which the drive signal VOUT is supplied receives an input of a reference voltage signal VBS as a representative example of the reference voltage signals VBS1** to VBSn.

Prior to giving a description of the configuration and operation of the drive signal selection circuit 200, an example of the waveforms of the drive signals COMA and COMB inputted into the drive signal selection circuit 200, and an example of the waveforms of the drive signal VOUT outputted from the drive signal selection circuit 200, are explained first below.

Figure 3:
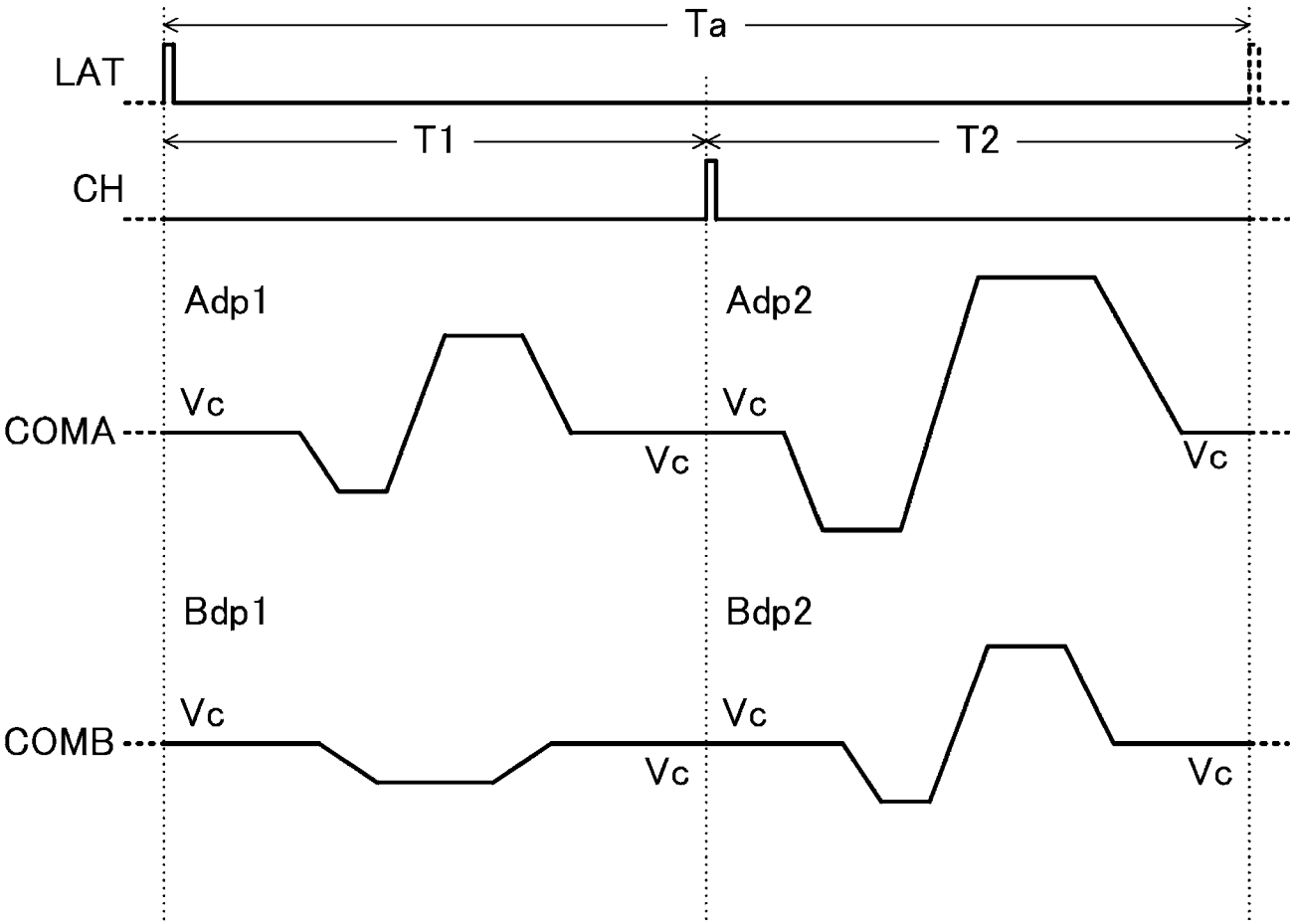
FIG. 3 is a diagram that illustrates an example of the waveforms of drive signals COMA and COMB.

FIG. 3 is a diagram that illustrates an example of the waveforms of the drive signals COMA and COMB. As illustrated in FIG. 3, the waveform of the drive signal COMA is a seamlessly-combined waveform made up of a trapezoidal waveform Adp1 during a period T1 from the rising of the latch signal LAT to the rising of the change signal CH and a trapezoidal waveform Adp2 during a period T2 from the rising of the change signal CH to the next rising of the latch signal LAT. When the trapezoidal waveform Adp1 is supplied to the discharging head 21, a small amount of ink is discharged from the corresponding nozzle. When the trapezoidal waveform Adp2 is supplied to the discharging head 21, a medium amount of ink, which is larger than the small amount, is discharged from the corresponding nozzle.

The waveform of the drive signal COMB is a seamlessly-combined waveform made up of a trapezoidal waveform Bdp1 during the period T1 and a trapezoidal waveform Bdp2 during the period T2. When the trapezoidal waveform Bdp1 is supplied to the discharging head 21, no ink is discharged from the corresponding nozzle. The trapezoidal waveform Bdp1 is a waveform for preventing the viscosity of ink from increasing, wherein the prevention is achieved by causing minute vibrations in ink near the orifice of the nozzle. When the trapezoidal waveform Bdp2 is supplied to the discharging head 21, a small amount of ink is discharged from the corresponding nozzle, similarly to the case of supply of the trapezoidal waveform Adp1.

The voltage at the timing of the start and end of each of the trapezoidal waveforms Adp1, Adp2, Bdp1, and Bdp2 is a voltage Vc, which is common to them. That is, each of the trapezoidal waveforms Adp1, Adp2, Bdp1, and Bdp2 starts at the voltage Vc and ends at the voltage Vc. A cycle Ta, which is made up of the periods T1 and T2, corresponds to a print cycle of forming a dot on the medium P.

In FIG. 3, the trapezoidal waveform Adp1 and the trapezoidal waveform Bdp2 are depicted to be the same as each other. However, they may be different from each other. Although it is described that a small amount of ink is discharged from the nozzles both in a case where the trapezoidal waveform Adp1 is supplied to the discharging head 21 and a case where the trapezoidal waveform Bdp2 is supplied to the discharging head 21, the scope of the present disclosure is not limited to this example. That is, the waveforms of the drive signals COMA and COMB are not limited to the example illustrated in FIG. 3. Depending on the movement speed of the carriage 24 on which the discharging head 21 is mounted, the property of ink contained at the ink container portion 8, the material of the medium P, and/or other factors, signals based on combinations of various waveforms may be used. The waveforms of the drive signals COMA1 to COMAn and COMB1 to COMBn corresponding respectively to the discharging heads 21-1 to **21-*n*** may be different from one another.

Figure 4:
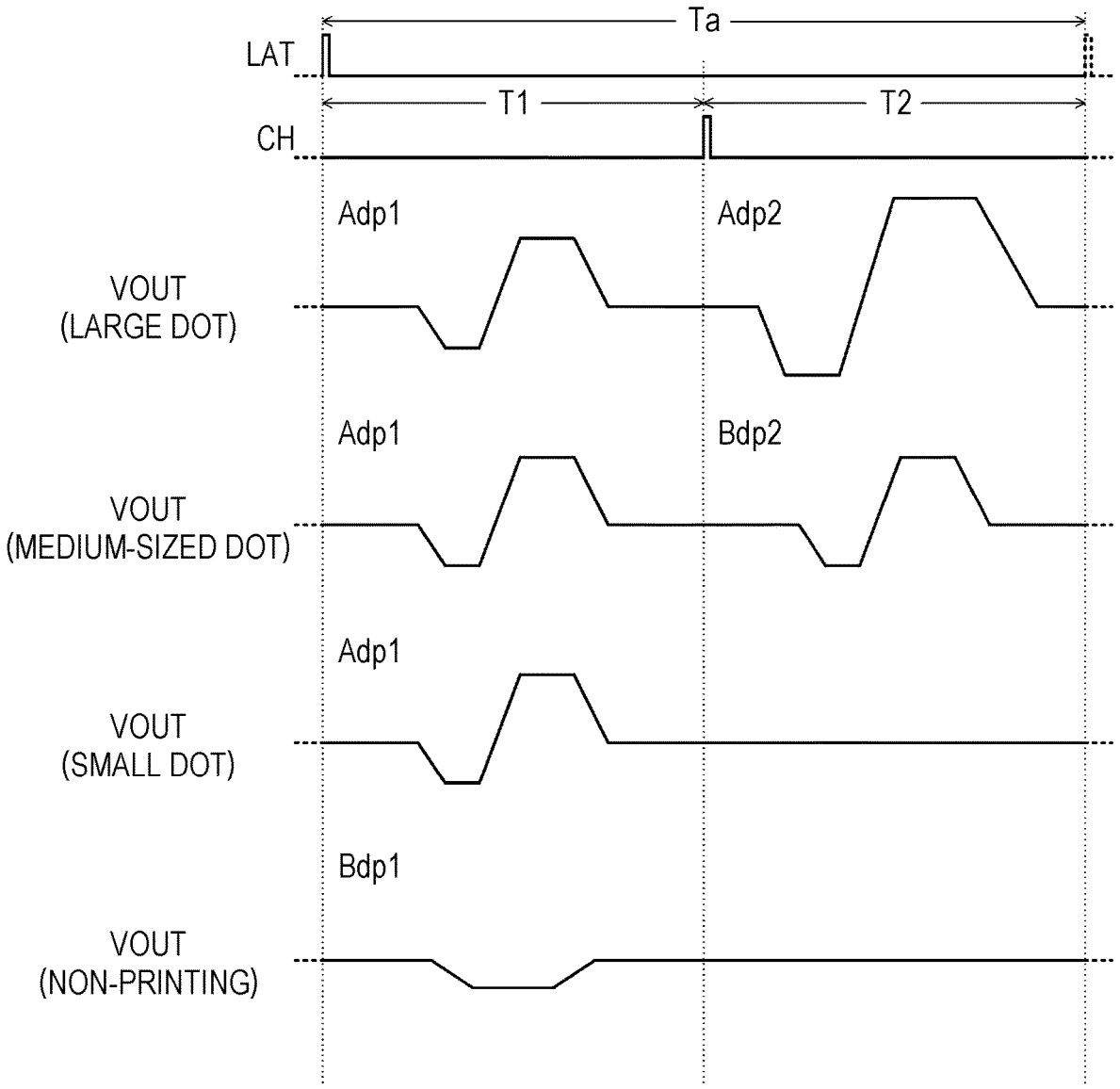
FIG. 4 is a diagram that illustrates an example of the waveforms of a drive signal VOUT.

FIG. 4 is a diagram that illustrates an example of the waveforms of the drive signal VOUT for cases where the size of the dot to be formed on the medium P is "large", "medium", "small" and a case of "non-printing", respectively.

As illustrated in FIG. 4, the waveform of the drive signal VOUT for a case where a "large dot" is to be formed on the medium P is a seamlessly-combined waveform made up of the trapezoidal waveform Adp1 during the period T1 and the trapezoidal waveform Adp2 during the period T2. When the drive signal VOUT having this waveform is supplied to the discharging head 21, a small amount of ink and a medium amount of ink are discharged from the corresponding nozzle within the cycle Ta. Therefore, due to the merging of the respective ink droplets on the medium P into one, a large dot is formed thereon.

The waveform of the drive signal VOUT for a case where a "medium-sized dot" is to be formed on the medium P is a seamlessly-combined waveform made up of the trapezoidal waveform Adp1 during the period T1 and the trapezoidal waveform Bdp2 during the period T2. When the drive signal VOUT having this waveform is supplied to the discharging head 21, a small amount of ink is discharged twice from the corresponding nozzle within the cycle Ta. Therefore, due to the merging of the respective ink droplets on the medium P into one, a medium-sized dot is formed thereon.

The waveform of the drive signal VOUT for a case where a "small dot" is to be formed on the medium P is a seamlessly-combined waveform made up of the trapezoidal waveform Adp1 during the period T1 and a flat waveform that is constant at the voltage Vc during the period T2. When the drive signal VOUT having this waveform is supplied to the discharging head 21, a small amount of ink is discharged from the corresponding nozzle within the cycle Ta. Therefore, due to the landing of this ink droplet onto the medium P, a small dot is formed thereon.

The waveform of the drive signal VOUT corresponding to "non-printing", in which no dot is to be formed on the medium P, is a seamlessly-combined waveform made up of the trapezoidal waveform Bdp1 during the period T1 and a flat waveform that is constant at the voltage Vc during the period T2. When the drive signal VOUT having this waveform is supplied to the discharging head 21, no ink is discharged within the cycle Ta, except that minute vibrations occur in ink near the orifice of the corresponding nozzle. Since no ink droplet is ejected onto the medium P, no dot is formed thereon.

The flat waveform that is constant at the voltage Vc is a waveform of retention of the immediately-preceding voltage Vc when none of the trapezoidal waveforms Adp1, Adp2, Bdp1, and Bdp2 is selected for the drive signal VOUT. Therefore, it can be said that the voltage Vc is supplied as the drive signal VOUT to the discharging head 21 when none of the trapezoidal waveforms Adp1, Adp2, Bdp1, and Bdp2 is selected for the drive signal VOUT.

Figure 5:
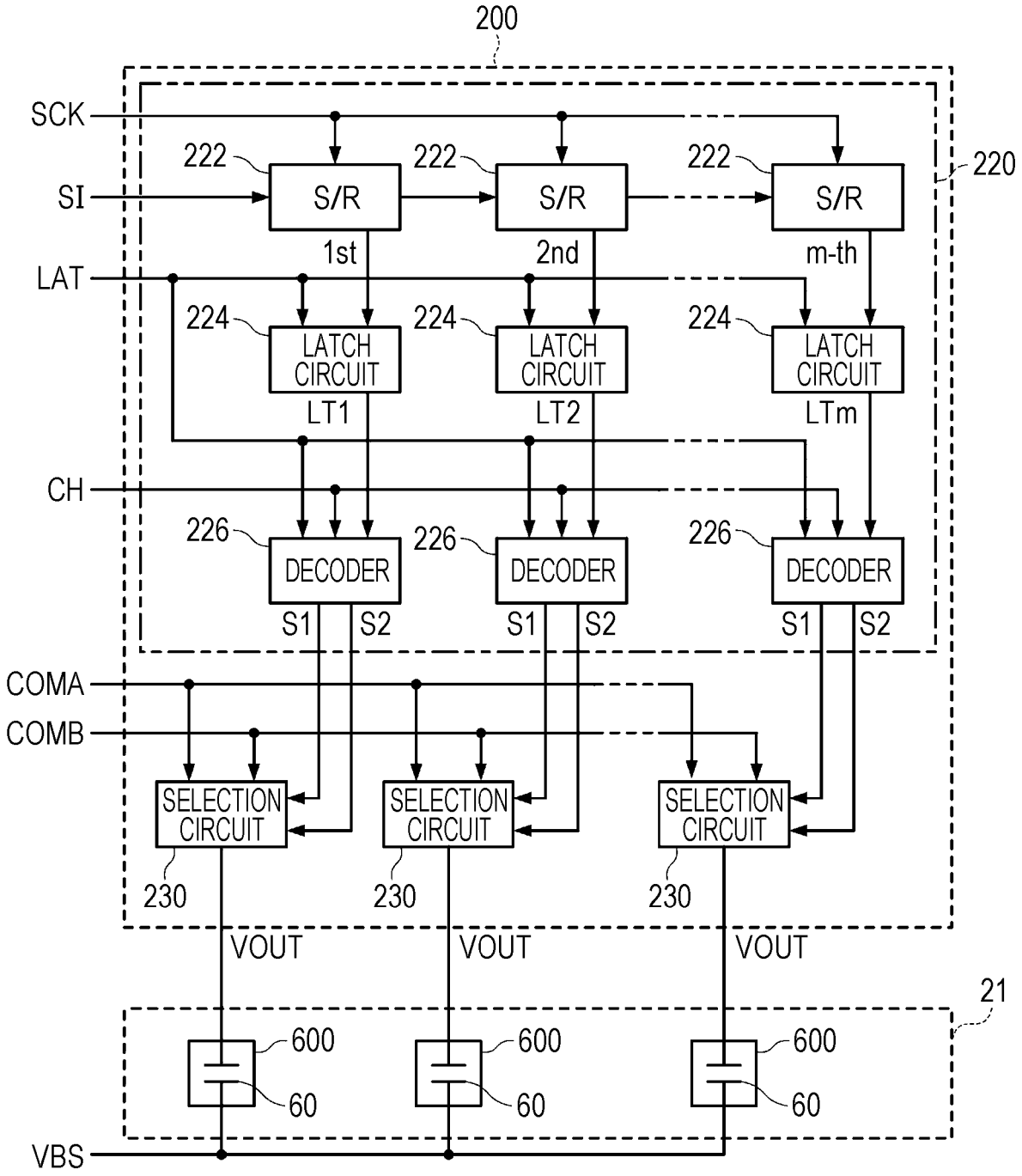
FIG. 5 is a diagram that illustrates a configuration of a drive signal selection circuit.

The drive signal selection circuit 200 generates the drive signal VOUT by selecting or not selecting the waveform of the drive signal COMA and the waveform of the drive signal COMB, and outputs it to the discharging head 21. FIG. 5 is a diagram that illustrates a configuration of the drive signal selection circuit 200. As illustrated in FIG. 5, the drive signal selection circuit 200 includes a selection control circuit 220 and a plurality of selection circuits 230. The discharging head 21 to which the drive signal VOUT outputted from the drive signal selection circuit 200 is supplied includes a plurality m of dischargers 600.

The print data signal SI, the latch signal LAT, the change signal CH, and the clock signal SCK are inputted into the selection control circuit 220. Groups each consisting of a shift register (S/R) 222, a latch circuit 224, and a decoder 226 are provided in the selection control circuit 220, wherein the groups correspond respectively to the plurality m of dischargers 600 of the discharging head 21. Namely, the drive signal selection circuit 200 includes the groups each consisting of the shift register 222, the latch circuit 224, and the decoder 226, wherein the number of the groups is equal to the number of the plurality, m, of dischargers 600 of the discharging head 21.

The print data signal SI is a signal synchronized with the clock signal SCK. The print data signal SI is a signal of 2m bits in total, containing pieces of 2-bit print data [SIH, SIL] for selecting any one of "large dot", "medium-sized dot", "small dot", and "non-printing" for the plurality m of dischargers 600 respectively. The pieces of 2-bit print data [SIH, SIL] contained in the inputted print data signal SI are stored into the shift registers 222 corresponding to the plurality m of dischargers 600 respectively. Specifically, in the selection control circuit 220, m stages of shift registers 222 corresponding to the plurality m of dischargers 600 are connected in a cascade arrangement, and the print data signal SI inputted serially is sequentially transferred to the next stage in accordance with the clock signal SCK. In FIG. 5, for the purpose of distinguishing the shift registers 222 from one another, they are sequentially labeled with the first stage, the second stage, . . . , the m-th stage from upstream in the sequential flow of the input of the print data signal SI.

At the rising of the latch signal LAT, each of the plurality m of latch circuits 224 latches the 2-bit print data [SIH, SIL] stored by the corresponding one of the plurality m of shift registers 222.

Figures 6, 7:
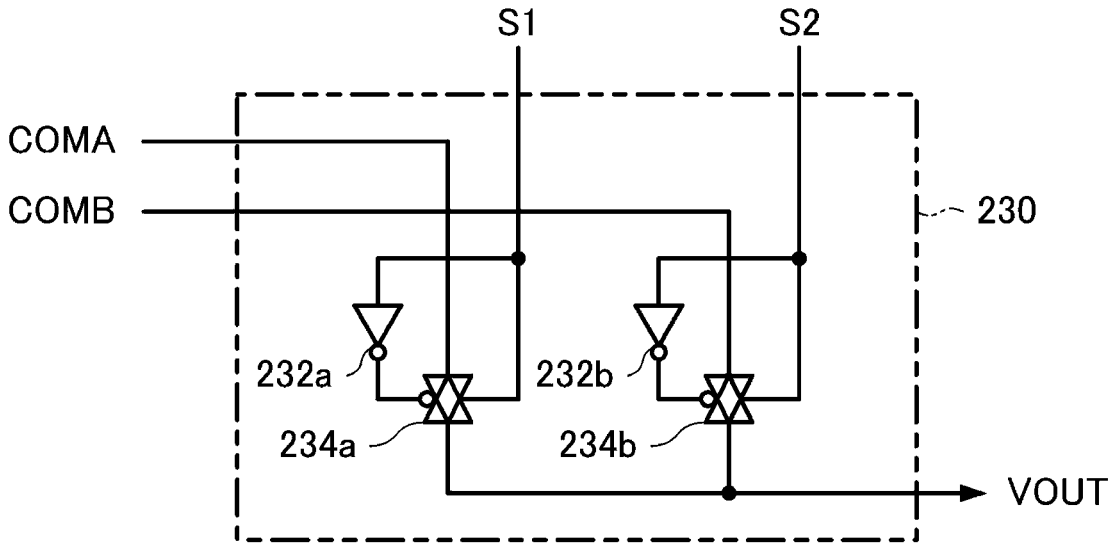
FIG. 6 is a table that shows the content of decoding by a decoder.
FIG. 7 is a diagram that illustrates a configuration of a selection circuit corresponding to one of dischargers.

FIG. 6 is a table that shows the content of decoding by the decoder 226. The decoder 226 outputs selection signals S1 and S2 in accordance with the latched 2-bit print data [SIH, SIL]. For example, if the 2-bit print data [SIH, SIL] is [1, 0], the decoder 226 outputs the logical level of the selection signal S1 as the H level in the period T1 and as the L level in the period T2 to the selection circuit 230, and outputs the logical level of the selection signal S2 as the L level in the period T1 and as the H level in the period T2 to the selection circuit 230.

Each of the selection circuits 230 is provided for the corresponding one of dischargers 600. That is, the number of the plurality of selection circuits 230 of the drive signal selection circuit 200 is equal to the number of the plurality, m, of dischargers 600 corresponding thereto. FIG. 7 is a diagram that illustrates a configuration of the selection circuit 230 corresponding to one of the dischargers 600. As illustrated in FIG. 7, the selection circuit 230 includes inverters 232*a* and 232*b*, which are NOT circuits, and transfer gates 234*a* and 234*b*.

The selection signal S1 is inputted into the positive control terminal without a circle mark of the transfer gate 234*a*, and is, on the other side, inputted into the negative control terminal with a circle mark of the transfer gate 234*a* through logical inversion by the inverter 232*a*. The drive signal COMA is supplied to the input terminal of the transfer gate 234*a*. The selection signal S2 is inputted into the positive control terminal without a circle mark of the transfer gate 234*b*, and is, on the other side, inputted into the negative control terminal with a circle mark of the transfer gate 234*b* through logical inversion by the inverter 232*b*. The drive signal COMB is supplied to the input terminal of the transfer gate 234*b*. The output terminal of the transfer gate 234*a* and the output terminal of the transfer gate 234*b* are connected in common, and the drive signal VOUT is outputted.

Specifically, the transfer gate 234*a* provides an electrical continuity between the input terminal and the output terminal if the selection signal S1 is in the H level, and provides no electrical continuity between the input terminal and the output terminal if the selection signal S1 is in the L level. The transfer gate 234*b* provides an electrical continuity between the input terminal and the output terminal if the selection signal S2 is in the H level, and provides no electrical continuity between the input terminal and the output terminal if the selection signal S2 is in the L level. As explained above, based on the selection signal S1 and the selection signal S2, the selection circuit 230 performs selection regarding the waveform of the drive signal COMA and the waveform of the drive signal COMB, and outputs the drive signal VOUT.

Figure 8:
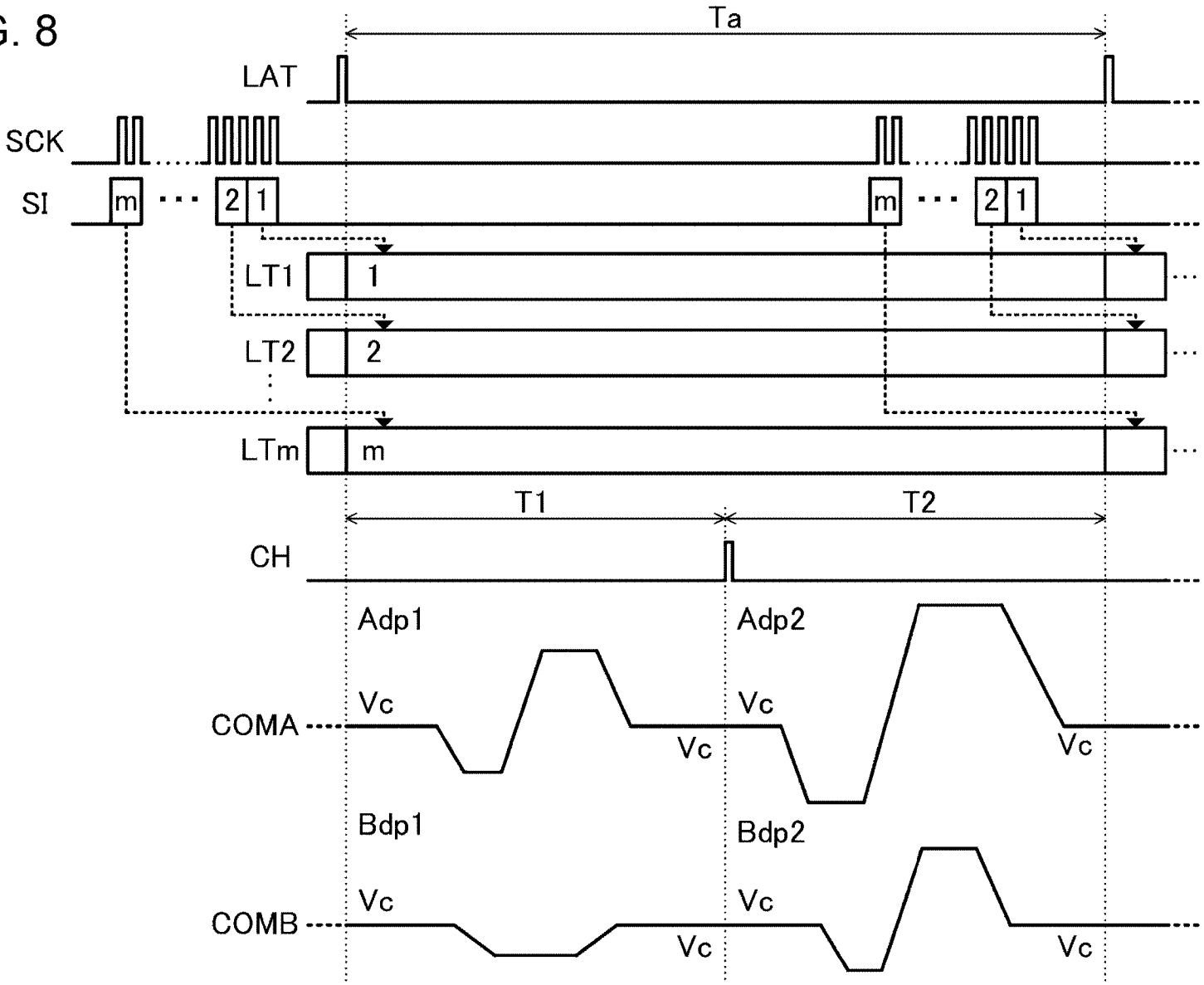
FIG. 8 is a diagram for explaining the operation of the drive signal selection circuit.

With reference to FIG. 8, the operation of the drive signal selection circuit 200 will now be explained. FIG. 8 is a diagram for explaining the operation of the drive signal selection circuit 200. The print data signal SI is inputted serially in sync with the clock signal SCK and is sequentially transferred through the shift registers 222 corresponding to the dischargers 600. Upon the stopping of the input of the clock signal SCK, the pieces of 2-bit print data [SIH, SIL] corresponding respectively to the dischargers 600 are stored into the shift registers 222. The pieces of 2-bit print data [SIH, SIL] contained in the print data signal SI are inputted in the order corresponding to the dischargers 600 for the m-th stage, . . . , the second stage, the first stage of the shift registers 222.

The latch circuits 224 latch the pieces of 2-bit print data [SIH, SIL] stored in the shift registers 222 all at once when the latch signal LAT rises. In FIG. 8, LT1, LT2, . . . , LTm denote the pieces of 2-bit print data [SIH, SIL] latched by the latch circuits 224 corresponding to the first stage, the second stage, . . . , the m-th stage of the shift registers 222.

The decoder 226 outputs the logical levels of the selection signals S1 and S2 in accordance with the content of the table in FIG. 6 in the periods T1 and T2, depending on the dot size specified by the latched 2-bit print data [SIH, SIL].

Specifically, if the print data [SIH, SIL] is [1, 1], the decoder 226 outputs the logical level of the selection signal S1 as the H level in the period T1 and as the H level in the period T2, and outputs the logical level of the selection signal S2 as the L level in the period T1 and as the L level in the period T2. In this case, the selection circuit 230 selects the trapezoidal waveform Adp1 in the period T1 and the trapezoidal waveform Adp2 in the period T2. As a result, the drive signal VOUT corresponding to a "large dot" shown in FIG. 4 is generated.

If the print data [SIH, SIL] is [1, 0], the decoder 226 outputs the logical level of the selection signal S1 as the H level in the period T1 and as the L level in the period T2, and outputs the logical level of the selection signal S2 as the L level in the period T1 and as the H level in the period T2. In this case, the selection circuit 230 selects the trapezoidal waveform Adp1 in the period T1 and the trapezoidal waveform Bdp2 in the period T2. As a result, the drive signal VOUT corresponding to a "medium-sized dot" shown in FIG. 4 is generated.

If the print data [SIH, SIL] is [0, 1], the decoder 226 outputs the logical level of the selection signal S1 as the H level in the period T1 and as the L level in the period T2, and outputs the logical level of the selection signal S2 as the L level in the period T1 and as the L level in the period T2. In this case, the selection circuit 230 selects the trapezoidal waveform Adp1 in the period T1 and neither of the trapezoidal waveform Adp2 and the trapezoidal waveform Bdp2 in the period T2. As a result, the drive signal VOUT corresponding to a "small dot" shown in FIG. 4 is generated.

If the print data [SIH, SIL] is [0, 0], the decoder 226 outputs the logical level of the selection signal S1 as the L level in the period T1 and as the L level in the period T2, and outputs the logical level of the selection signal S2 as the H level in the period T1 and as the L level in the period T2. In this case, the selection circuit 230 selects the trapezoidal waveform Bdp1 in the period T1 and neither of the trapezoidal waveform Adp2 and the trapezoidal waveform Bdp2 in the period T2. As a result, the drive signal VOUT corresponding to "non-printing" shown in FIG. 4 is generated.

As explained above, based on the print data signal SI, the latch signal LAT, the change signal CH, and the clock signal SCK, the drive signal selection circuit 200 performs selection regarding the waveform of the drive signal COMA and the waveform of the drive signal COMB, and outputs the selection result as the drive signal VOUT.

4. Structure of Discharging Head

Figure 9:
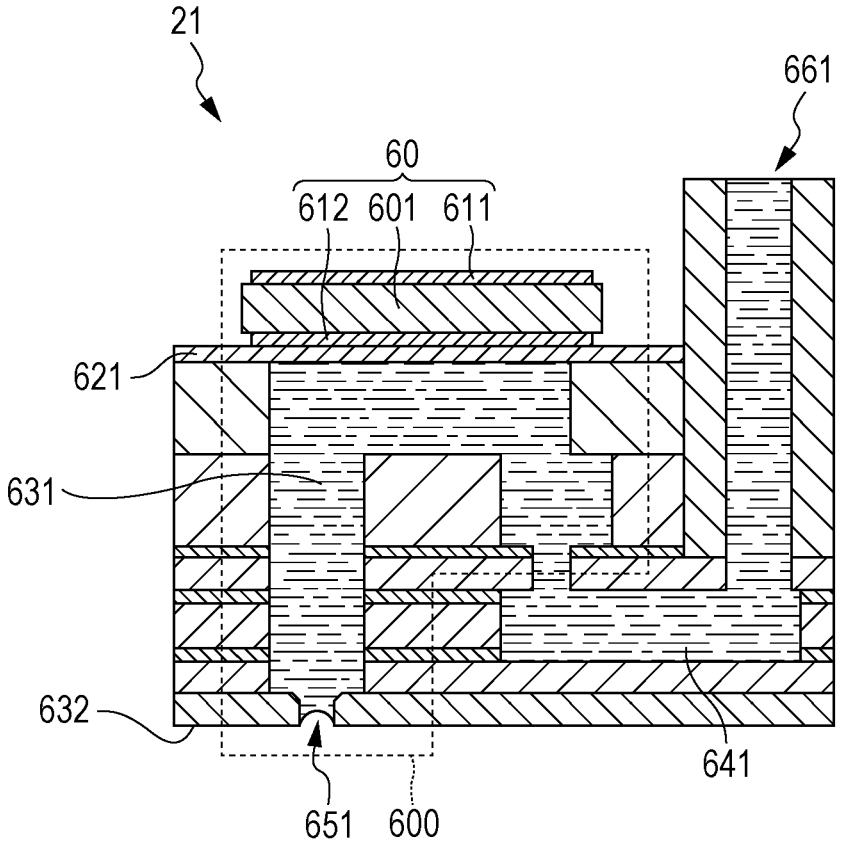
FIG. 9 is a diagram that illustrates a structure of the discharger.

Next, the structure of one of the plurality m of dischargers 600 included in the discharging head 21 will now be explained. FIG. 9 is a diagram that illustrates a structure of the discharger 600. As illustrated in FIG. 9, the discharger 600 includes a piezoelectric element 60, a vibrating plate 621, a cavity 631, and a nozzle 651. The vibrating plate 621 moves when the piezoelectric element 60 provided on its upper surface in FIG. 9 is driven. The vibrating plate 621 behaves as a diaphragm that increases/decreases the internal capacity of the cavity 631. The inside of the cavity 631 is filled with ink. The cavity 631 behaves as a pressure compartment, the internal capacity of which changes due to deformative movement of the vibrating plate 621 caused by the driving of the piezoelectric element 60. The nozzle 651 is an orifice portion that is formed though a nozzle plate 632 and is in communication with the cavity 631. Due to a change in the internal capacity of the cavity 631, ink contained inside the cavity 631 is discharged from the nozzle 651. Ink supplied through an ink supply port 661 is supplied to the cavity 631 via a reservoir 641.

The piezoelectric element 60 has a structure of sandwiching a piezoelectric body 601 between a pair of electrodes 611 and 612. In accordance with a potential difference between the electrodes 611 and 612, the piezoelectric body 601 in this structure at the center portion of the electrodes 611 and 612 and the vibrating plate 621 deforms in the vertical direction in FIG. 9 with respect to both ends. Specifically, the drive signal VOUT is supplied to the electrode 611, which is one terminal of the piezoelectric element 60, and the reference voltage signal VBS is supplied to the electrode 612, which is the opposite terminal of the piezoelectric element 60. The center portion of the piezoelectric element 60 deforms upward when the voltage of the drive signal VOUT decreases. The center portion of the piezoelectric element 60 deforms downward when the voltage of the drive signal VOUT increases. The vibrating plate 621 moves upward due to the upward deformation of the piezoelectric element 60, thereby increasing the internal capacity of the cavity 631. Therefore, ink is sucked in from the reservoir 641. The vibrating plate 621 moves downward due to the downward deformation of the piezoelectric element 60, thereby decreasing the internal capacity of the cavity 631. Therefore, ink whose amount corresponds to the degree of the decrease in the internal capacity of the cavity 631 is discharged from the nozzle 651.

As explained above, the discharger 600 includes the piezoelectric element 60 and discharges ink onto the medium P by the driven operation of the piezoelectric element 60. The structure of the piezoelectric element 60 is not limited to the illustrated structure. Any other structure may be adopted as long as it is possible to discharge ink by deformative action of the piezoelectric element 60. The vibration mode of the piezoelectric element 60 is not limited to flexural vibration. Longitudinal vibration may be used instead.

5. Layout of Boards and Line Connection Therebetween

As explained above, the liquid discharging apparatus 1 according to the present embodiment includes: the drive unit 20 that includes the discharging head 21 that discharges ink; the main circuit board 11 that includes the control circuit 100 that outputs various kinds of signals for controlling the discharging head 21; and the cables 191, 192, and 193 for electrical coupling between the control circuit 100, which is mounted on the main circuit board 11, and the drive unit 20. The drive unit 20 includes the drive circuit board 30 that is electrically coupled to the cables 191, 192, and 193. In other words, the cables 191, 192, and 193 electrically couple the main circuit board 11 and the drive circuit board 30 to each other. Signals supplied from the main circuit board 11 to the drive circuit board 30 and signals supplied from the drive circuit board 30 to the main circuit board 11 propagate via the cables 191, 192, and 193.

The drive unit 20 further includes the discharge circuit board 40. In the drive unit 20, the drive circuit board 30 and the discharge circuit board 40 are electrically coupled via the cable 195. In other words, the cable 195 electrically couples the drive circuit board 30 and the discharge circuit board 40 to each other. Signals supplied from the drive circuit board 30 to the discharge circuit board 40 and signals supplied from the discharge circuit board 40 to the drive circuit board 30 propagate via the cable 195. The signals inputted into the discharge circuit board 40 are supplied to the discharging head 21. By this means, ink is discharged from the discharging head 21.

In the liquid discharging apparatus 1 having the structure described above, the main circuit board 11, the drive circuit board 30 included in the drive unit 20, the discharge circuit board 40, and the cables 191, 192, 193, and 195 are housed inside the body 2 illustrated in FIG. 1. More specifically, the main circuit board 11, the drive circuit board 30 included in the drive unit 20, and the cables 191, 192, and 193 are located inside the body 2 of the liquid discharging apparatus 1 and behind the printing unit 5. The discharge circuit board 40 is mounted in the carriage 24. The cable 195 electrically couples the drive circuit board 30 and the discharge circuit board 40 to each other.

Figure 10:
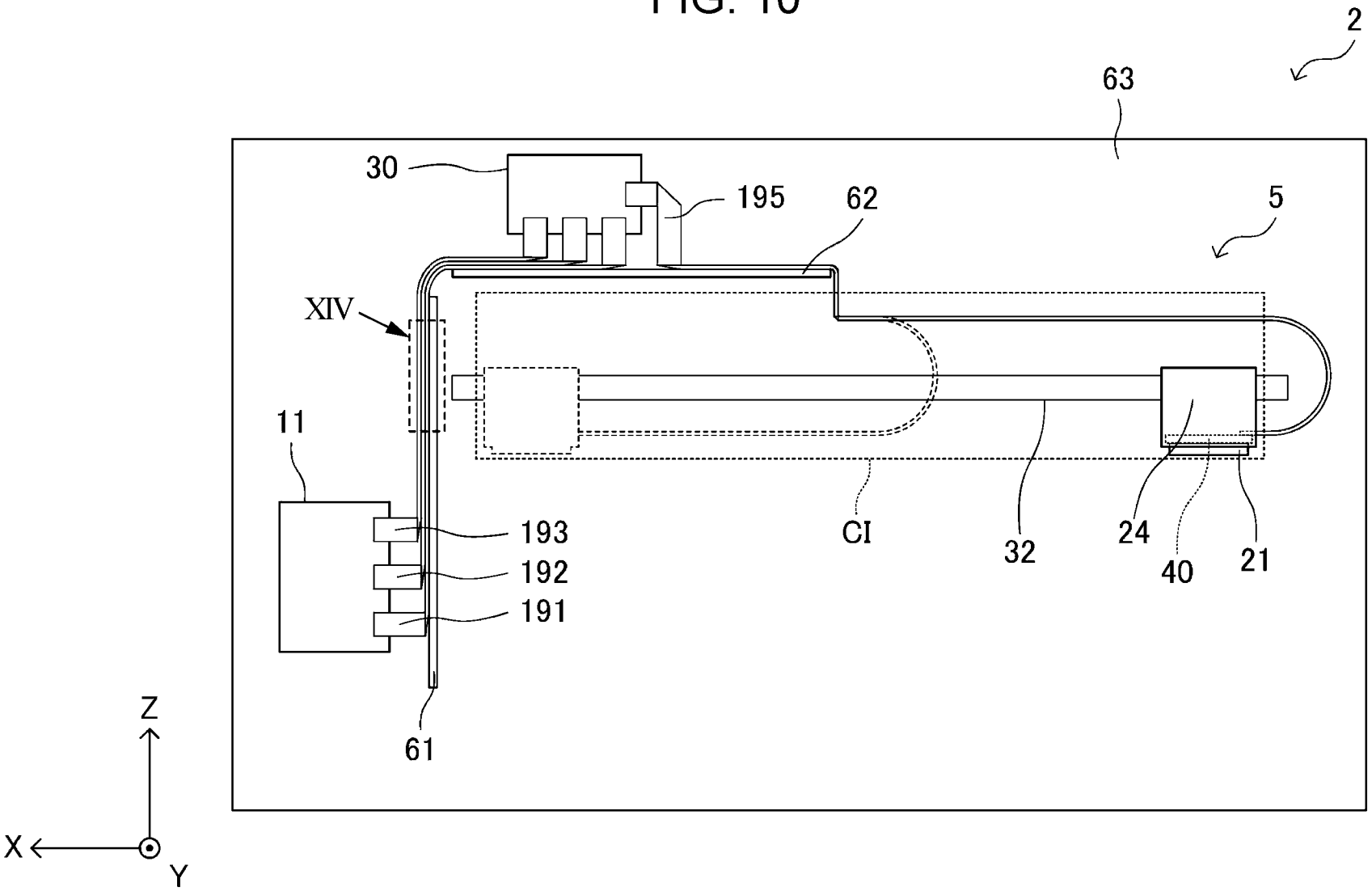
FIG. 10 is a front view for explaining the layout of those housed inside a body, specifically, a main circuit board, a drive circuit board, a discharge circuit board, and cables for electrical coupling between the circuit boards.
Figure 11:
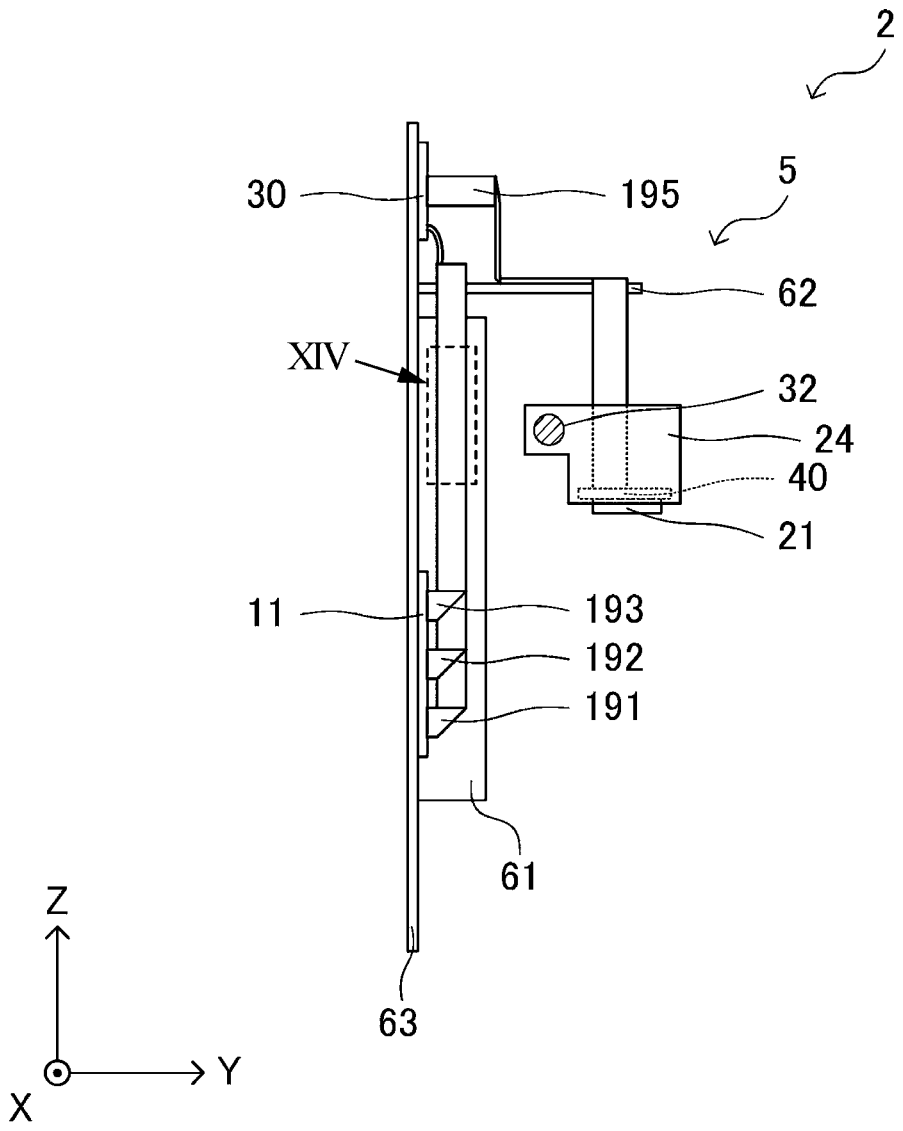
FIG. 11 is a side view for explaining the positional relationships among those housed inside the body, specifically, the main circuit board, the drive circuit board, the discharge circuit board, and the cables for electrical coupling between the circuit boards.

With reference to FIGS. 10 and 11, the layout of those housed inside the body 2 of the liquid discharging apparatus 1, specifically, the main circuit board 11, the drive circuit board 30 included in the drive unit 20, the discharge circuit board 40, the cables 191, 192, and 193 for electrical coupling between the main circuit board 11 and the drive circuit board 30, and the cable 195 for electrical coupling between the drive circuit board 30 and the discharge circuit board 40, will now be explained.

FIG. 10 is a front view for explaining the layout of those housed inside the body 2, specifically, the main circuit board 11, the drive circuit board 30, the discharge circuit board 40, and the cables 191, 192, 193, and 195 for electrical coupling between the circuit boards. FIG. 11 is a side view for explaining the positional relationships among those housed inside the body 2, specifically, the main circuit board 11, the drive circuit board 30, the discharge circuit board 40, and the cables 191, 192, 193, and 195 for electrical coupling between the circuit boards.

As illustrated in FIGS. 10 and 11, the main circuit board 11 and the drive circuit board 30 are fastened to a wall portion 63 via insulating members that are not illustrated. The wall portion 63 is a wall member provided at the rear of the body 2 and contains a conductive material such as, for example, iron or aluminum. The wall portion 63 is grounded to a reference potential and is connected via a capacitor, etc. to the ground potential of circuits mounted on the main circuit board 11 and the drive circuit board 30. The wall portion 63 includes two raised portions 61 and 62. Each of the raised portions 61 and 62 contains a conductive material such as, for example, iron or aluminum and is fastened to the wall portion 63 with rivets or screws or by welding, or the like. The potential of the raised portions 61 and 62 is the same as the potential of the wall portion 63. Each of the raised portions 61 and 62 may be formed by bending a part of the wall portion 63. Namely, the raised portions 61 and 62 and the wall portion 63 may be formed integrally. The raised portions 61 and 62 and the wall portion 63 constitute a part of the body 2. Namely, the body 2 is an example of housing. The raised portions 61 and 62 and the wall portion 63, which constitute a part of the body 2, are also an example of housing.

The main circuit board 11 and the drive circuit board 30 are electrically coupled to each other via the cables 191, 192, and 193. Therefore, signals generated by the main circuit board 11 propagate via the cables 191, 192, and 193 and are inputted into the drive circuit board 30, and signals outputted from the drive circuit board 30 propagate via the cables 191, 192, and 193 and are inputted into the main circuit board 11.

Each of the cables 191, 192, and 193 according to the present embodiment is a flexible flat cable (FFC) in which plural conductors for signal propagation are arranged next to one another. More specifically, each of the cables 191 and 193 is an FFC that does not include a shield layer containing a conductive material, and the cable 192 is a shielded FFC that includes a shield layer containing a conductive material. The pitch between terminals of the cable 193 is larger than the pitch between terminals of the cable 191.

Figure 12:
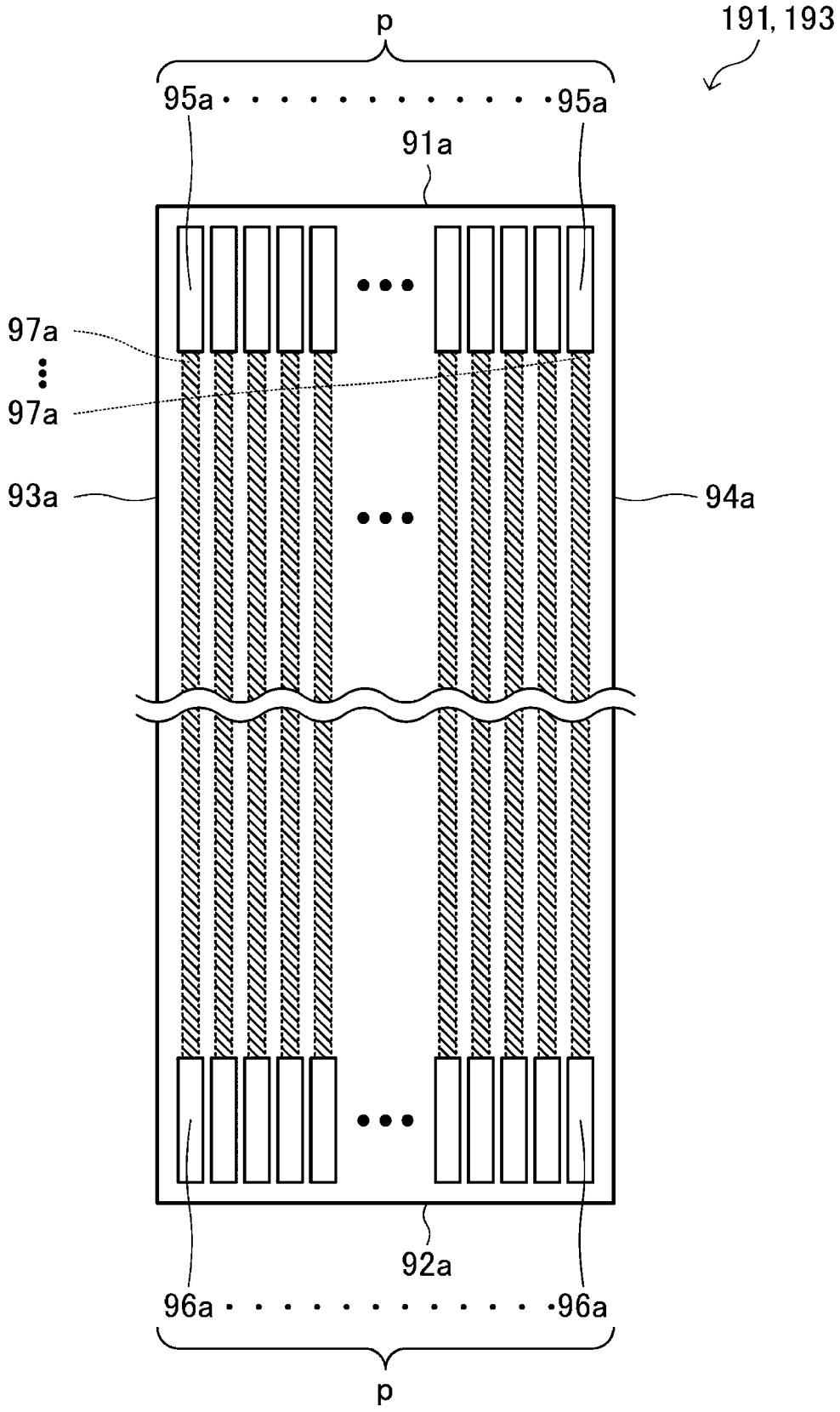
FIG. 12 is a diagram that illustrates an example of the structure of a cable that does not include a shield layer containing a conductive material.
Figure 13:
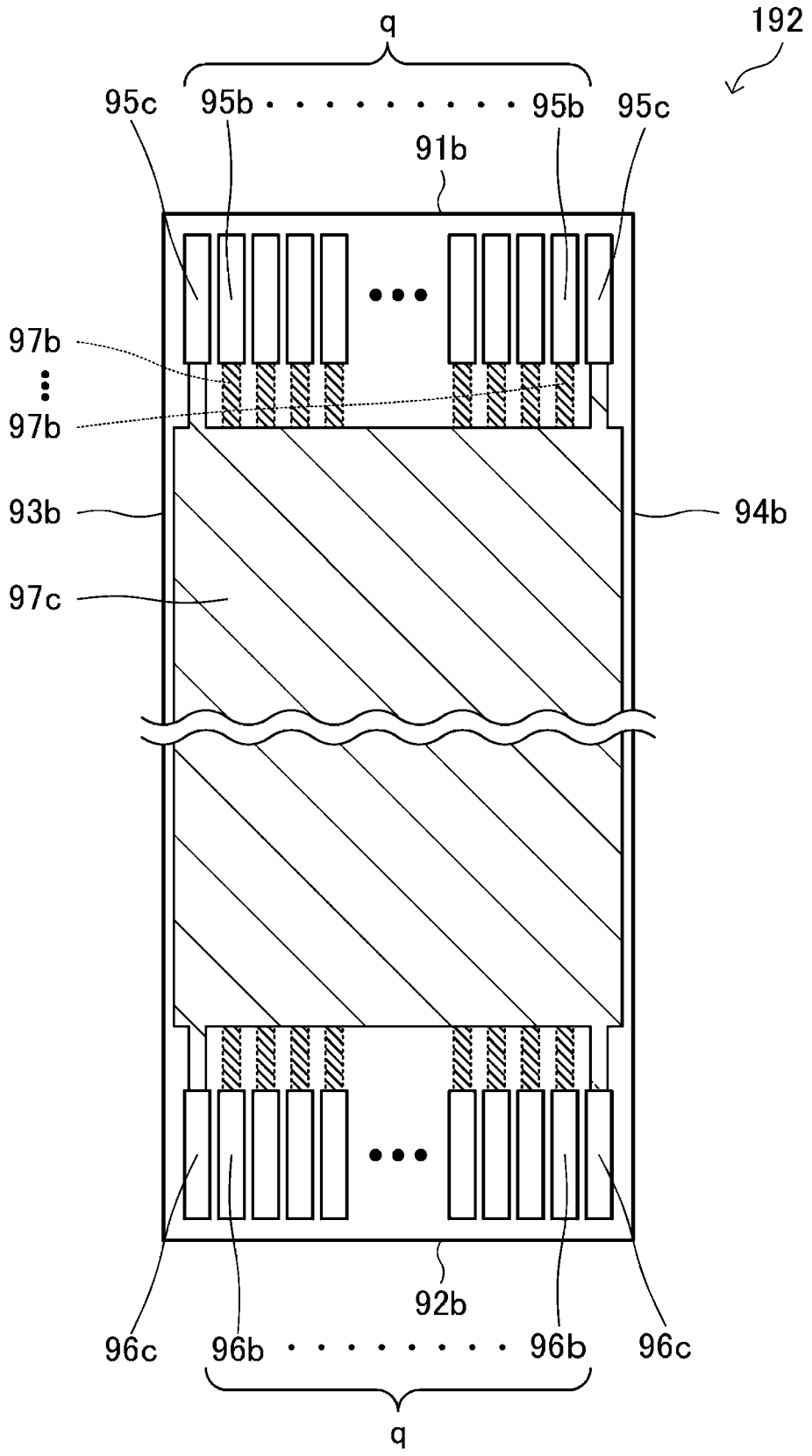
FIG. 13 is a diagram that illustrates an example of the structure of a cable that includes a shield layer containing a conductive material.

With reference to FIGS. 12 and 13, a specific example of the structure of the cables 191, 192, and 193 will now be explained. FIG. 12 is a diagram that illustrates an example of the structure of the cable 191, 193, which does not include a shield layer containing a conductive material. FIG. 13 is a diagram that illustrates an example of the structure of the cable 192, which includes a shield layer containing a conductive material. The structure of the cable 193 is the same as the structure of the cable 191. Therefore, the cable 191 is used for explanation with reference to FIG. 12, and description about the cable 193 will be omitted.

As illustrated in FIG. 12, the cable 191 has a substantially rectangular shape having short sides 91*a* and 92*a* opposite each other and long sides 93*a* and 94*a* opposite each other. The cable 191 includes a plurality p of terminals 95*a*, a plurality p of terminals 96*a*, and a plurality p of wires 97*a*.

Along the short side 91*a* of the cable 191, the plurality p of terminals 95*a* are arranged next to one another from the long side 93*a* toward the long side 94*a*. Along the short side 92*a* of the cable 191, the plurality p of terminals 96*a* are arranged next to one another from the long side 93*a* toward the long side 94*a*. The plurality p of wires 97*a* electrically connect the respective terminals 95*a* to the respective terminals 96*a*, and are arranged next to one another from the long side 93*a* toward the long side 94*a*. The plurality p of wires 97*a* are coated with an insulating member that is not illustrated.

In the cable 191 having the above structure, signals inputted respectively into either one of the plurality p of terminals 95*a* and the plurality p of terminals 96*a* propagate through the corresponding wires 97*a* and are outputted respectively from the other of the plurality p of terminals 95*a* and the plurality p of terminals 96*a*.

As illustrated in FIG. 2, among the signals that propagate from the main circuit board 11 to the drive circuit board 30, each pair of differential signals dSI1+ to dSIn+ and dSI1− to dSIn−, the pair of differential signals dSCK+ and dSCK−, the latch signal LAT, and the change signal CH propagate via the cable 191. This means that signals having comparatively high frequencies and small voltage values for controlling the operation of the drive unit 20 propagate via the cable 191. Therefore, the cable 191 is required to allow many kinds of signals to propagate, and it is better for the cable 191 to include many wires 97*a*.

By contrast, among the signals that propagate from the main circuit board 11 to the drive circuit board 30, the voltages VHV and VDD propagate via the cable 193. This means that signals having large voltage values such as a power supply voltage for causing the drive unit 20 to operate propagate via the cable 193. Therefore, there is a possibility that an electric current having a comparatively large value might flow through the cable 193 and thus it will be advantageous if the wiring width of the wire 97*a* is wide. Namely, the terminal pitch of the cable 193 may be larger than the terminal pitch of the cable 191.

The cable 191 is an example of a first cable, and the cable 193 is an example of a third cable. The cable 193, via which a power supply voltage for causing the drive unit 20 to operate propagates, is an example of a fourth cable, too. Among the signals that propagate via the cable 191, at least any of each pair of differential signals dSI1+ to dSIn+ and dSI1− to dSIn−, the pair of differential signals dSCK+ and dSCK−, the latch signal LAT, and the change signal CH is an example of a first signal. The cable 193 may be configured as two or more FFCs.

The cable 191 described above does not include a shield layer containing a conductive material, whereas the cable 192 includes a shield layer containing a conductive material, and, as illustrated in FIG. 13, the cable 192 has a substantially rectangular shape having short sides 91*b* and 92*b* opposite each other and long sides 93*b* and 94*b* opposite each other. The cable 192 includes a plurality q of terminals 95*b*, a plurality q of terminals 96*b*, a plurality of terminals 95*c*, a plurality of terminals 96*c*, a plurality q of wires 97*b*, and a leaf wire 97*c*.

Along the short side 91*b* of the cable 192, the plurality q of terminals 95*b* are arranged next to one another from the long side 93*b* toward the long side 94*b*. Along the short side 92*b* of the cable 192, the plurality q of terminals 96*b* are arranged next to one another from the long side 93*b* toward the long side 94*b*. The plurality q of wires 97*b* electrically connect the respective terminals 95*b* to the respective terminals 96*b*, and are arranged next to one another from the long side 93*b* toward the long side 94*b*. The plurality q of wires 97*b* are coated with an insulating member that is not illustrated.

The plurality of terminals 95*c* are provided near the long side 93*b* and near the long side 94*b* alongside the plurality q of terminals 95*b* arranged next to one another from the long side 93*b* toward the long side 94*b* along the short side 91*b*. The plurality of terminals 96*c* are provided near the long side 93*b* and near the long side 94*b* alongside the plurality q of terminals 96*b* arranged next to one another from the long side 93*b* toward the long side 94*b* along the short side 92*b*. The leaf wire 97*c* electrically connects the plurality of terminals 95*c* to the plurality of terminals 96*c*. The plurality q of wires 97*b* is covered by the leaf wire 97*c*, with the insulating member therebetween.

In the cable 192 having the above structure, signals inputted respectively into either one of the plurality q of terminals 95*b* and the plurality q of terminals 96*b* propagate through the corresponding wires 97*b* and are outputted respectively from the other of the plurality q of terminals 95*b* and the plurality q of terminals 96*b*. A signal of a constant potential including a ground signal is inputted into each of the plurality of terminals 95*c* and into each of the plurality of terminals 96*c*. Therefore, the leaf wire 97*c* is at the constant potential level. Since the cable 192 includes the leaf wire 97*c* to which a constant potential is supplied, the leaf wire 97*c* plays a role of a shield layer, and, as a result, the risk of contamination of signals propagating through the plurality q of wires 97*b* with noise is reduced.

The plurality of terminals 95*c*, 96*c*, which are electrically connected to the leaf wire 97*c*, may be provided between the plurality q of terminals 95*b*, 96*b* arranged next to one another. The leaf wire 97*c* according to the present embodiment is provided also alongside both ends of the plurality q of wires 97*b* arranged next to one another in the cable 192, though not illustrated in FIG. 13. In other words, the leaf wire 97*c* may be provided in such a way as to enclose both ends of the plurality q of wires 97*b* in the cable 192. Providing the leaf wire 97*c* in such a way as to enclose both ends of the plurality q of wires 97*b* makes it possible to further reduce the risk of contamination of signals propagating through the plurality q of wires 97*b* with noise.

As illustrated in FIG. 2, the pair of differential signals sDAB+ and sDAB− and the pair of differential signals sDCK+ and sDCK− propagate via the cable 192 among the signals that propagate from the main circuit board 11 to the drive circuit board 30, and the temperature abnormality detection signal XHOT and the temperature information signal TH propagate via the cable 192 as the signals that propagate from the drive circuit board 30 to the main circuit board 11.

The pair of differential signals sDAB+ and sDAB− are signals obtained by converting the source drive signals DA1 to DAn and DB1 to DBn into signals in a serial format and further converting the converted signals in the serial format into a pair of differential signals sDAB+ and sDAB−. Therefore, in comparison with the frequencies of each pair of differential signals dSI1+ to dSIn+ and dSI1− to dSIn−, the pair of differential signals dSCK+ and dSCK−, the latch signal LAT, and the change signal CH, which propagate via the cable 191, the frequency of the pair of differential signals sDAB+ and sDAB− is higher. In other words, a frequency of a signal that propagates via the cable 191 is lower than a frequency of a signal that propagates via the cable 192. Since the cable 192, via which signals having higher frequencies propagate, is shielded with the leaf wire 97*c*, the emission of radiation noise from the cable 192 is reduced, and the risk of contamination of signals propagating via the cable 192 with external noise is reduced.

The temperature abnormality detection signal XHOT and the temperature information signal TH are important signals that indicate the status of the discharging head 21. If these signals are contaminated with noise, etc., the risk of malfunction of the liquid discharging apparatus 1 increases. Shielding the cable 192, via which such an important signal indicating the status of the discharging head 21 propagates, with the leaf wire 97*c* makes it possible to increase the accuracy of detecting whether any abnormality has occurred in the liquid discharging apparatus 1 or not and reduce the risk of malfunction of the liquid discharging apparatus 1 caused by erroneous abnormality detection.

The cable 192 is an example of a second cable. At least either the pair of differential signals sDAB+ and sDAB− or the pair of differential signals sDCK+ and sDCK− is an example of a second signal. At least either the temperature abnormality detection signal XHOT or the temperature information signal TH is an example of a third signal.

Referring back to FIGS. 10 and 11, the cables 191, 192, and 193 for electrical coupling between the main circuit board 11 and the drive circuit board 30 are routed along the raised portions 61 and 62. Specifically, one end of each of the cables 191, 192, and 193 is electrically coupled to the main circuit board 11. The cables 191, 192, and 193 electrically coupled to the main circuit board 11 are routed along the raised portions 61 and 62 such that the cables 191, 192, and 193 are stacked in layers in this order from the raised portions 61 and 62. The other end of each of the cables 191, 192, and 193 is electrically coupled to the drive circuit board 30.

Figure 14:
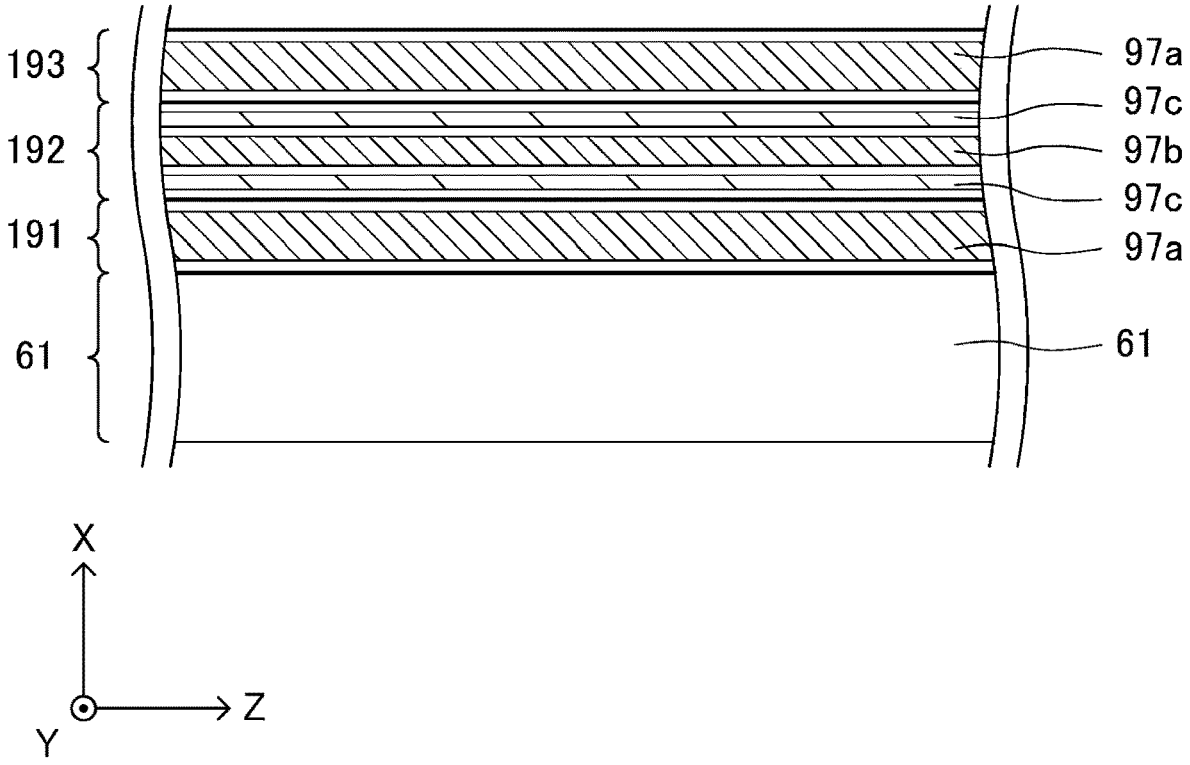
FIG. 14 is an enlarged view of the portion XIV illustrated in FIGS. 10 and 11.

FIG. 14 is an enlarged view of the portion XIV illustrated in FIGS. 10 and 11. As illustrated in FIG. 14, the cables 191, 192, and 193 are provided along the raised portions 61 and 62 such that the cables 191, 192, and 193 are stacked in layers in this order from the raised portion 61.

Specifically, the cable 191 is stacked above the raised portion 61. In this case, the wires 97*a* included in the cable 191 extend in the Z direction in FIG. 14 and are arranged next to one another in the Y direction. The cable 192 is stacked above the cable 191. More specifically, a stack of the leaf wire 97*c*, the wires 97*b*, and the leaf wire 97*c* in this order of the cable 192 is provided above the cable 191. In this case, the wires 97*b* included in the cable 192 extend in the Z direction in FIG. 14 and are arranged next to one another in the Y direction. That is, the cable 191 is provided between the raised portion 61 and the cable 192. More specifically, the position of the cable 191 is between the raised portion 61 and the leaf wire 97*c* of the cable 192.

As described earlier, a reference potential that is a ground potential is supplied via the wall portion 63 to the raised portion 61. Similarly, a signal of a constant potential is supplied to the leaf wire 97*c*. Therefore, the raised portion 61 and the leaf wire 97*c* of the cable 192 closer to the cable 191 play a role of a shield member that reduces the influence of noise on the cable 191. In this case, the cable 191 may be in contact with at least one of the cable 192 and the raised portion 61 as illustrated in FIG. 14. The contact of the cable 191 with at least one of the cable 192 and the raised portion 61 further reduces the risk of the cable 191 being affected by noise. For the purpose of contact of the cable 191 with at least one of the cable 192 and the raised portion 61, the liquid discharging apparatus 1 may include a non-illustrated fastening portion for fastening the cables 191, 192, and 193 to the raised portion 61.

The cable 193 is stacked above the cable 192. More specifically, the cable 193 is provided above the stack of the leaf wire 97*c*, the wires 97*b*, and the leaf wire 97*c* in this order of the cable 192. In this case, the wires 97*a* included in the cable 193 extend in the Z direction in FIG. 14 and are arranged next to one another in the Y direction. Namely, the position of the cable 192 is between the cable 191 and the cable 193.

Because of this structure, the leaf wire 97*c* of the cable 192 plays a role of a shield member that shields the cables 191 and 192 from signals propagating via the cable 193. In other words, this reduces the risk of contamination of signals propagating via the cables 191 and 192 with signals propagating via the cable 193.

6. Operational Effects

The liquid discharging apparatus 1 according to the present embodiment described above includes: the main circuit board 11 that includes the control circuit 100 that controls the discharging head 21; the cable 191 for electrical coupling between the control circuit 100 and the drive unit 20; the cable 192 for electrical coupling between the control circuit 100 and the drive unit 20; and the body 2 inside which the drive unit 20, the main circuit board 11, and the cables 191 and 192 are housed. In the liquid discharging apparatus 1 having the structure described above, the cable 192 includes the leaf wire 97*c* that is an example of a shield layer containing a conductive material, and the position of the cable 191 is between the body 2 and the cable 192. Because of this structure, the leaf wire 97*c* plays a role of a shield member that provides a shield to signals propagating via the cable 192. Therefore, the risk of contamination of signals propagating via the cable 192 with external noise is reduced.

The leaf wire 97*c* provided in the cable 192, and the body 2, play a role of a shield member that provides a shield to signals propagating via the cable 191. Therefore, the risk of contamination of signals propagating via the cable 191 with external noise is reduced. Therefore, in the liquid discharging apparatus 1 in which the plurality of cables is used for signal propagation, it is possible to reduce the risk of contamination of signals propagating via the cable 191 with external noise, without any need for providing a shield member at least for the cable 191. This reduces the mutual interference of signals propagating via the cable 191 and signals propagating via the cable 192 with each other and prevents the area occupied by the cables 191 and 192 in the liquid discharging apparatus 1 from increasing and thus prevents an increase in the size of the liquid discharging apparatus 1.

7. Variation Example

In the above description of the liquid discharging apparatus 1 according to the foregoing embodiment, a serial-scan-type ink jet printer that discharges ink to targeted positions on the medium P by reciprocation, in sync with the transportation of the medium P, of the carriage 24 on which the discharging head 21 is mounted is taken as an example. However, the liquid discharging apparatus 1 may be a so-called line-type ink jet printer that is provided with an array of discharging heads 21 arranged next to one another with an array width equal to or greater than the width of the medium P to be transported, and discharges ink to targeted positions on the medium P just by transporting the medium P.

In the foregoing embodiment, it is described that the drive circuit board 30 that outputs the drive signals COMA and COMB to the discharging head 21 is fastened to the wall portion 63 of the body 2. However, it is sufficient as long as the position of the cable 191 for coupling between the drive circuit board 30 and the main circuit board 11 is between the cable 192 and the wall portion 63 or the raised portion 61, 62 having the same potential as the wall portion 63. Accordingly, the drive circuit board 30 may be mounted in the carriage 24.

Even if the liquid discharging apparatus 1 is modified as shown in the above variation examples, the same or similar operational effects can be expected.

Although a certain exemplary embodiment and some variation examples are described above, the scope of the present disclosure is not limited to them. The present disclosure can be modified in various ways within a scope of not departing from the gist thereof. For example, some examples in the foregoing embodiment may be combined as needed.

The scope of the present disclosure encompasses a structure that is substantially the same as the structure described in the embodiment (for example, a structure with the same function, method, and result, or a structure with the same object and effects). The scope of the present disclosure encompasses a structure that is obtained by replacing a non-essential part in the structure described in the embodiment with an alternative. The scope of the present disclosure encompasses a structure that produces the same operational effects as that of the structure described in the embodiment, or a structure that achieves the same object as that of the structure described in the embodiment. The scope of the present disclosure further encompasses a structure that is obtained by adding known art to the structure described in the embodiment.

What is claimed is:

1. A liquid discharging apparatus, comprising:

a drive unit that includes a discharging head that discharges liquid;

a first board that includes a control circuit that controls the discharging head;

a first cable for electrical coupling between the control circuit and the drive unit;

a second cable for electrical coupling between the control circuit and the drive unit; and housing inside which the drive unit, the first board, the first cable, and the second cable are housed; wherein the second cable includes a shield layer containing a conductive material, and a position of the first cable is between the housing and the second cable.

2. The liquid discharging apparatus according to claim 1, wherein the drive unit includes a second board electrically coupled to the first cable and the second cable, and the first board and the second board are fastened to the housing.

3. The liquid discharging apparatus according to claim 1, wherein the first cable does not include a shield layer containing a conductive material.

4. The liquid discharging apparatus according to claim 1, further comprising:

a third cable that has a terminal pitch larger than a terminal pitch of the first cable; wherein a position of the second cable is between the first cable and the third cable.

5. The liquid discharging apparatus according to claim 1, further comprising:

a fourth cable via which a power voltage of the drive unit propagates; wherein a position of the second cable is between the first cable and the fourth cable.

6. The liquid discharging apparatus according to claim 1, wherein the first cable is in contact with at least one of the second cable and the housing.

7. The liquid discharging apparatus according to claim 1, wherein a frequency of a first signal that propagates via the first cable is lower than a frequency of a second signal that propagates via the second cable.

8. The liquid discharging apparatus according to claim 1, wherein a third signal that indicates a status of the discharging head propagates via the second cable.

* * * * *